US009697843B2

(12) United States Patent
Ramadas et al.

(10) Patent No.: US 9,697,843 B2
(45) Date of Patent: Jul. 4, 2017

(54) HIGH BAND EXCITATION SIGNAL GENERATION

(71) Applicant: QUALCOMM Incorporated, San Diego, CA (US)

(72) Inventors: Pravin Kumar Ramadas, San Diego, CA (US); Daniel J. Sinder, San Diego, CA (US); Stephane Pierre Villette, San Diego, CA (US); Vivek Rajendran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 270 days.

(21) Appl. No.: 14/265,693

(22) Filed: Apr. 30, 2014

(65) Prior Publication Data

US 2015/0317994 A1 Nov. 5, 2015

(51) Int. Cl.
*G10L 19/08* (2013.01)
*G10L 19/24* (2013.01)

(52) U.S. Cl.
CPC ..... *G10L 19/08* (2013.01); *G10L 19/24* (2013.01)

(58) Field of Classification Search
CPC ..... G10L 19/24; G10L 19/08
USPC ..... 704/226
See application file for complete search history.

(56) References Cited

U.S. PATENT DOCUMENTS 4,764,966 A * 8/1988 Einkauf ..... H04Q 1/46 370/435
5,473,727 A 12/1995 Nishiguchi et al.
5,857,147 A * 1/1999 Gardner ..... G10L 19/22 370/236
6,556,967 B1 * 4/2003 Nelson ..... G10L 25/78 704/208
6,675,144 B1 1/2004 Tucker et al.
6,888,938 B2 * 5/2005 Cui ..... H04M 19/001 379/390.02
7,330,814 B2 2/2008 McCree
8,140,324 B2 3/2012 Vos et al.
8,260,611 B2 9/2012 Vos et al.
(Continued)

FOREIGN PATENT DOCUMENTS

WO WO 2006130221 A1 * 12/2006 ..... G10L 19/0208
WO 2013066238 A2 5/2013
WO 2013066238 A3 5/2013

OTHER PUBLICATIONS

Agiomyrgiannakis et al "Combined estimation/coding of highband spectral envelopes for speech spectrum expansion," International Conference on Acoustics, Speech, and Signal Processing, Jun. 2004, pp. I469-I-472.*

(Continued)

*Primary Examiner* — David Hudspeth
*Assistant Examiner* — Oluwadamilola M Ogunbiyi
(74) *Attorney, Agent, or Firm* — Toler Law Group, PC

(57) ABSTRACT

A particular method includes determining, at a device, a voicing classification of an input signal. The input signal corresponds to an audio signal. The method also includes controlling an amount of an envelope of a representation of the input signal based on the voicing classification. The method further includes modulating a white noise signal based on the controlled amount of the envelope. The method also includes generating a high band excitation signal based on the modulated white noise signal.

30 Claims, 9 Drawing Sheets

(56) References Cited

U.S. PATENT DOCUMENTS 8,370,153 B2 * 2/2013 Hirose ..... G10L 19/06 704/226
8,600,072 B2 * 12/2013 Park ..... H04R 3/007 704/226
9,330,682 B2 * 5/2016 Suzuki ..... G10L 25/78
2002/0007280 A1 * 1/2002 McCree ..... G10L 19/0208 704/500
2002/0184009 A1 * 12/2002 Heikkinen ..... G10L 19/0204 704/219
2003/0055654 A1 * 3/2003 Oudeyer ..... G10L 17/26 704/275
2003/0065506 A1 * 4/2003 Adut ..... G10L 19/18 704/207
2003/0101048 A1 * 5/2003 Liu ..... G10L 21/0208 704/208
2003/0216908 A1 * 11/2003 Berestesky ..... H03G 3/3089 704/208
2004/0181399 A1 9/2004 Gao
2005/0004793 A1 * 1/2005 Ojala ..... G10L 21/038 704/219
2005/0065788 A1 * 3/2005 Stachurski ..... G10L 19/20 704/229
2006/0064301 A1 * 3/2006 Aguilar ..... G10L 19/093 704/233
2007/0027681 A1 * 2/2007 Kim ..... G10L 25/93 704/208
2008/0027717 A1 * 1/2008 Rajendran ..... G10L 21/038 704/210
2011/0099004 A1 4/2011 Krishnan et al.
2012/0016667 A1 * 1/2012 Gao ..... G10L 21/038 704/203
2012/0065965 A1 3/2012 Choo et al.
2012/0116758 A1 * 5/2012 Murgia ..... G10L 19/24 704/226
2013/0216053 A1 * 8/2013 Disch ..... G10H 1/08 381/61
2014/0122065 A1 * 5/2014 Daimou ..... G10L 19/24 704/205
2014/0229170 A1 * 8/2014 Atti ..... G10L 21/0264 704/225
2014/0229171 A1 * 8/2014 Atti ..... G10L 21/0388 704/225
2014/0257827 A1 * 9/2014 Norvell ..... G10L 19/26 704/500
2014/0288925 A1 * 9/2014 Sverrisson ..... G10L 21/038 704/206
2015/0106107 A1 * 4/2015 Atti ..... G10L 19/035 704/500
2015/0279384 A1 * 10/2015 Atti ..... G10L 19/24 704/223

OTHER PUBLICATIONS

International Search Report and Written Opinion of the International Searching Authority (EPO) for International Application No. PCT/US2015/023483, mailed Jun. 3, 2015, 13 pages.

Enhanced Variable Rate Codec, Speech Service Options 3, 68, 70, and 73 for Wideband Spread Spectrum Digital Systems, 3rd Generation Partnership 2 "3GPP2", 3GPP2 C.S0014-D, Version 1.0, May 2009, p. 1-308.

Campbell, J. Jr., Voiced/Unvoiced classification of speech with applications to the U.S. government LPC-10E algorithm, Acoustics, Speech, and Signal Processing, IEEE International Conference on ICASSP (vol. 11 ), Apr. 1986, 473-476.

* cited by examiner

HIGH BAND EXCITATION SIGNAL GENERATION

I. FIELD

The present disclosure is generally related to high band excitation signal generation.

II. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

Transmission of voice by digital techniques is widespread, particularly in long distance and digital radio telephone applications. If speech is transmitted by sampling and digitizing, a data rate on the order of sixty-four kilobits per second (kbps) may be used to achieve a speech quality of an analog telephone. Compression techniques may be used to reduce the amount of information that is sent over a channel while maintaining a perceived quality of reconstructed speech. Through the use of speech analysis, followed by coding, transmission, and re-synthesis at a receiver, a significant reduction in the data rate may be achieved.

Devices for compressing speech may find use in many fields of telecommunications. For example, wireless communications has many applications including, e.g., cordless telephones, paging, wireless local loops, wireless telephony such as cellular and personal communication service (PCS) telephone systems, mobile Internet Protocol (IP) telephony, and satellite communication systems. A particular application is wireless telephony for mobile subscribers.

Various over-the-air interfaces have been developed for wireless communication systems including, e.g., frequency division multiple access (FDMA), time division multiple access (TDMA), code division multiple access (CDMA), and time division-synchronous CDMA (TD-SCDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, and IS-95B (referred to collectively herein as IS-95), are promulgated by the Telecommunication Industry Association (TIA) and other well-known standards bodies to specify the use of a CDMA over-the-air interface for cellular or PCS telephony communication systems.

The IS-95 standard subsequently evolved into "3G" systems, such as cdma2000 and WCDMA, which provide more capacity and high speed packet data services. Two variations of cdma2000 are presented by the documents IS-2000 (cdma2000 1×RTT) and IS-856 (cdma2000 1×EV-DO), which are issued by TIA. The cdma2000 1×RTT communication system offers a peak data rate of 153 kbps whereas the cdma2000 1×EV-DO communication system defines a set of data rates, ranging from 38.4 kbps to 2.4 Mbps. The WCDMA standard is embodied in 3rd Generation Partnership Project "3GPP", Document Nos. 3G TS 25.211, 3G TS 25.212, 3G TS 25.213, and 3G TS 25.214. The International Mobile Telecommunications Advanced (IMT-Advanced) specification sets out "4G" standards. The IMT-Advanced specification sets a peak data rate for 4G service at 100 megabits per second (Mbit/s) for high mobility communication (e.g., from trains and cars) and 1 gigabit per second (Gbit/s) for low mobility communication (e.g., from pedestrians and stationary users).

Devices that employ techniques to compress speech by extracting parameters that relate to a model of human speech generation are called speech coders. Speech coders may comprise an encoder and a decoder. The encoder divides the incoming speech signal into blocks of time, or analysis frames. The duration of each segment in time (or "frame") may be selected to be short enough that the spectral envelope of the signal may be expected to remain relatively stationary. For example, a frame length may be twenty milliseconds, which corresponds to 160 samples at a sampling rate of eight kilohertz (kHz), although any frame length or sampling rate deemed suitable for a particular application may be used.

The encoder analyzes the incoming speech frame to extract certain relevant parameters and then quantizes the parameters into a binary representation, e.g., to a set of bits or a binary data packet. The data packets are transmitted over a communication channel (i.e., a wired and/or wireless network connection) to a receiver and a decoder. The decoder processes the data packets, unquantizes the processed data packets to produce the parameters, and resynthesizes the speech frames using the unquantized parameters.

The function of the speech coder is to compress the digitized speech signal into a low-bit-rate signal by removing natural redundancies inherent in speech. The digital compression may be achieved by representing an input speech frame with a set of parameters and employing quantization to represent the parameters with a set of bits. If the input speech frame has a number of bits $N_i$ and a data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Speech coders generally utilize a set of parameters (including vectors) to describe the speech signal. A good set of parameters ideally provides a low system bandwidth for the reconstruction of a perceptually accurate speech signal. Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (e.g., 5 millisecond (ms) sub-frames) at a time. For each sub-frame, a high-precision representative from a codebook space is found by means of a search algorithm. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques.

One time-domain speech coder is the Code Excited Linear Predictive (CELP) coder. In a CELP coder, the short-term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_o$, for each frame) or at a variable rate (in which different bit rates are used for different types of frame contents). Variable-rate coders attempt to use the amount of bits needed to encode the parameters to a level adequate to obtain a target quality.

Time-domain coders such as the CELP coder may rely upon a high number of bits, $N_0$, per frame to preserve the accuracy of the time-domain speech waveform. Such coders may deliver excellent voice quality provided that the number of bits, $N_o$, per frame is relatively large (e.g., 8 kbps or above). At low bit rates (e.g., 4 kbps and below), time-domain coders may fail to retain high quality and robust performance due to the limited number of available bits. At low bit rates, the limited codebook space clips the waveform-matching capability of time-domain coders, which are deployed in higher-rate commercial applications. Hence, many CELP coding systems operating at low bit rates suffer from perceptually significant distortion characterized as noise.

An alternative to CELP coders at low bit rates is the "Noise Excited Linear Predictive" (NELP) coder, which operates under similar principles as a CELP coder. NELP coders use a filtered pseudo-random noise signal to model speech, rather than a codebook. Since NELP uses a simpler model for coded speech, NELP achieves a lower bit rate than CELP. NELP may be used for compressing or representing unvoiced speech or silence.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of such parametric coders is the LP vocoder.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, characterized as buzz.

In recent years, coders have emerged that are hybrids of both waveform coders and parametric coders. Illustrative of these hybrid coders is the prototype-waveform interpolation (PWI) speech coding system. The PWI speech coding system may also be known as a prototype pitch period (PPP) speech coder. A PWI speech coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal.

In traditional telephone systems (e.g., public switched telephone networks (PSTNs)), signal bandwidth is limited to the frequency range of 300 Hertz (Hz) to 3.4 kiloHertz (kHz). In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

Wideband coding techniques involve encoding and transmitting a lower frequency portion of a signal (e.g., 50 Hz to 7 kHz, also called the "low band"). In order to improve coding efficiency, the higher frequency portion of the signal (e.g., 7 kHz to 16 kHz, also called the "high band") may not be fully encoded and transmitted. Properties of the low band signal may be used to generate the high band signal. For example, a high band excitation signal may be generated based on a low band residual using a non-linear model (e.g., an absolute value function). When the low band residual is sparsely coded with pulses, the high band excitation signal generated from the sparsely coded residual may result in artifacts in unvoiced regions of the high band.

III. SUMMARY

Systems and methods for high band excitation signal generation are disclosed. An audio decoder may receive audio signals encoded by an audio encoder at a transmitting device. The audio decoder may determine a voicing classification (e.g., strongly voiced, weakly voiced, weakly unvoiced, strongly unvoiced) of a particular audio signal. For example, the particular audio signal may range from strongly voiced (e.g., a speech signal) to strongly unvoiced (e.g., a noise signal). The audio decoder may control an amount of an envelope of a representation of an input signal based on the voicing classification.

Controlling the amount of the envelope may include controlling a characteristic (e.g., a shape, a frequency range, a gain, and/or a magnitude) of the envelope. For example, the audio decoder may generate a low band excitation signal from an encoded audio signal and may control a shape of an envelope of the low band excitation signal based on the voicing classification. For example, the audio decoder may control a frequency range of the envelope based on a cut-off frequency of a filter applied to the low band excitation signal. As another example, the audio decoder may control a magnitude of the envelope, a shape of the envelope, a gain of the envelope, or a combination thereof, by adjusting one or more poles of linear predictive coding (LPC) coefficients based on the voicing classification. As a further example, the audio decoder may control the magnitude of the envelope, the shape of the envelope, the gain of the enveloper, or a combination thereof, by adjusting coefficients of a filter based on the voicing classification, where the filter is applied to the low band excitation signal.

The audio decoder may modulate a white noise signal based on the controlled amount of the envelope. For example, the modulated white noise signal may correspond more to the low band excitation signal when the voicing classification is strongly voiced than when the voicing classification is strongly unvoiced. The audio decoder may generate a high band excitation signal based on the modulated white noise signal. For example, the audio decoder may extend the low band excitation signal and may combine the modulated white noise signal and the extended low band signal to generate the high band excitation signal.

In a particular embodiment, a method includes determining, at a device, a voicing classification of an input signal. The input signal corresponds to an audio signal. The method also includes controlling an amount of an envelope of a representation of the input signal based on the voicing classification. The method further includes modulating a white noise signal based on the controlled amount of the envelope. The method includes generating a high band excitation signal based on the modulated white noise signal.

In another particular embodiment, an apparatus includes a voicing classifier, an envelope adjuster, a modulator, and an output circuit. The voicing classifier is configured to determine a voicing classification of an input signal. The input signal corresponds to an audio signal. The envelope adjuster is configured to control an amount of an envelope of a representation of the input signal based on the voicing classification. The modulator is configured to modulate a white noise signal based on the controlled amount of the envelope. The output circuit is configured to generate a high band excitation signal based on the modulated white noise signal.

In another particular embodiment, a computer-readable storage device stores instructions that, when executed by at least one processor, cause the at least one processor to determine a voicing classification of an input signal. The instructions, when executed by the at least one processor, further cause the at least one processor to control an amount of an envelope of a representation of the input signal based on the voicing classification, to modulate a white noise signal based on the controlled amount of the envelope, and to generate a high band excitation signal based on the modulated white noise signal.

Particular advantages provided by at least one of the disclosed embodiments include generating a smooth sounding synthesized audio signal corresponding to an unvoiced audio signal. For example, the synthesized audio signal corresponding to the unvoiced audio signal may have few (or no) artifacts. Other aspects, advantages, and features of the present disclosure will become apparent after review of the application, including the following sections: Brief Description of the Drawings, Detailed Description, and the Claims.

IV. BRIEF DESCRIPTION OF THE DRAWINGS

V. DETAILED DESCRIPTION

Figure 1:
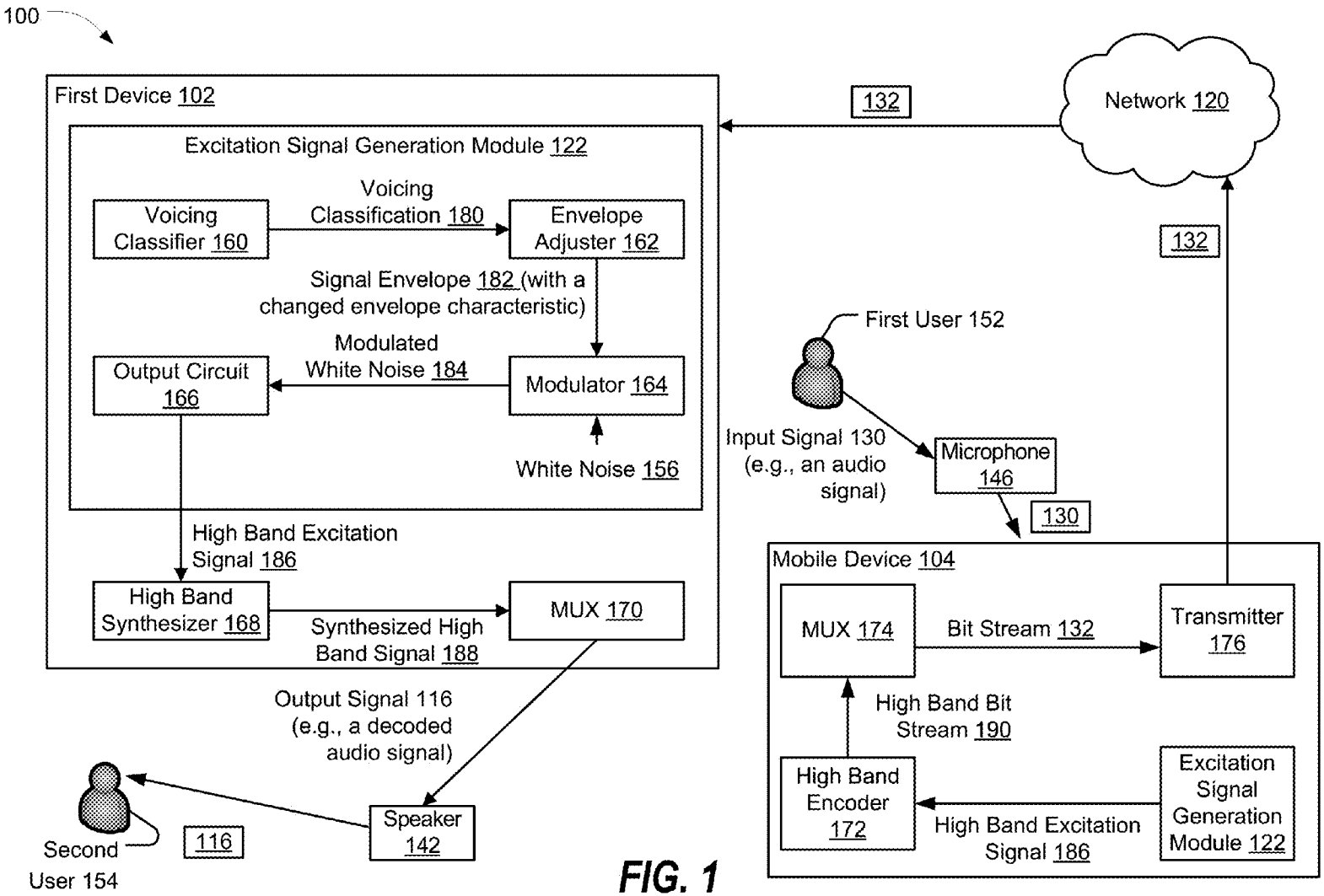
FIG. 1 is a diagram to illustrate a particular embodiment of a system including a device that is operable to perform high band excitation signal generation.

The principles described herein may be applied, for example, to a headset, a handset, or other audio device that is configured to perform high band excitation signal generation. Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from another component, block or device), and/or retrieving (e.g., from a memory register or an array of storage elements).

Unless expressly limited by its context, the term "producing" is used to indicate any of its ordinary meanings, such as calculating, generating, and/or providing. Unless expressly limited by its context, the term "providing" is used to indicate any of its ordinary meanings, such as calculating, generating, and/or producing. Unless expressly limited by its context, the term "coupled" is used to indicate a direct or indirect electrical or physical connection. If the connection is indirect, it is well understood by a person having ordinary skill in the art, that there may be other blocks or components between the structures being "coupled".

The term "configuration" may be used in reference to a method, apparatus/device, and/or system as indicated by its particular context. Where the term "comprising" is used in the present description and claims, it does not exclude other elements or operations. The term "based on" (as in "A is based on B") is used to indicate any of its ordinary meanings, including the cases (i) "based on at least" (e.g., "A is based on at least B") and, if appropriate in the particular context, (ii) "equal to" (e.g., "A is equal to B"). In the case (i) where A is based on B includes based on at least, this may include the configuration where A is coupled to B. Similarly, the term "in response to" is used to indicate any of its ordinary meanings, including "in response to at least." The term "at least one" is used to indicate any of its ordinary meanings, including "one or more". The term "at least two" is used to indicate any of its ordinary meanings, including "two or more".

The terms "apparatus" and "device" are used generically and interchangeably unless otherwise indicated by the particular context. Unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The terms "method," "process," "procedure," and "technique" are used generically and interchangeably unless otherwise indicated by the particular context. The terms "element" and "module" may be used to indicate a portion of a greater configuration. Any incorporation by reference of a portion of a document shall also be understood to incorporate definitions of terms or variables that are referenced within the portion, where such definitions appear elsewhere in the document, as well as any figures referenced in the incorporated portion.

As used herein, the term "communication device" refers to an electronic device that may be used for voice and/or data communication over a wireless communication network. Examples of communication devices include cellular phones, personal digital assistants (PDAs), handheld devices, headsets, wireless modems, laptop computers, personal computers, etc.

Referring to FIG. 1, a particular embodiment of a system that includes devices that are operable to perform high band excitation signal generation is shown and generally designated 100. In a particular embodiment, one or more components of the system 100 may be integrated into a decoding system or apparatus (e.g., in a wireless telephone or coder/decoder (CODEC)), into an encoding system or apparatus, or both. In other embodiments, one or more components of the system 100 may be integrated into a set top box, a music player, a video player, an entertainment unit, a navigation device, a communications device, a personal digital assistant (PDA), a fixed location data unit, or a computer.

It should be noted that in the following description, various functions performed by the system 100 of FIG. 1 are described as being performed by certain components or modules. This division of components and modules is for illustration only. In an alternate embodiment, a function performed by a particular component or module may be divided amongst multiple components or modules. Moreover, in an alternate embodiment, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

Although illustrative embodiments depicted in FIGS. 1-9 are described with respect to a high-band model similar to that used in Enhanced Variable Rate Codec-Narrowband-Wideband (EVRC-NW), one or more of the illustrative embodiments may use any other high-band model. It should be understood that use of any particular model is described for example only.

The system 100 includes a mobile device 104 in communication with a first device 102 via a network 120. The mobile device 104 may be coupled to or in communication with a microphone 146. The mobile device 104 may include an excitation signal generation module 122, a high band encoder 172, a multiplexer (MUX) 174, a transmitter 176, or a combination thereof. The first device 102 may be coupled to or in communication with a speaker 142. The first device 102 may include the excitation signal generation module 122 coupled to a MUX 170 via a high band synthesizer 168. The excitation signal generation module 122 may include a voicing classifier 160, an envelope adjuster 162, a modulator 164, an output circuit 166, or a combination thereof.

During operation, the mobile device 104 may receive an input signal 130 (e.g., a user speech signal of a first user 152, an unvoiced signal, or both). For example, the first user 152 may be engaged in a voice call with a second user 154. The first user 152 may use the mobile device 104 and the second user 154 may use the first device 102 for the voice call. During the voice call, the first user 152 may speak into the microphone 146 coupled to the mobile device 104. The input signal 130 may correspond to speech of the first user 152, background noise (e.g., music, street noise, another person's speech, etc.), or a combination thereof. The mobile device 104 may receive the input signal 130 via the microphone 146.

In a particular embodiment, the input signal 130 may be a super wideband (SWB) signal that includes data in the frequency range from approximately 50 hertz (Hz) to approximately 16 kilohertz (kHz). The low band portion of the input signal 130 and the high band portion of the input signal 130 may occupy non-overlapping frequency bands of 50 Hz-7 kHz and 7 kHz-16 kHz, respectively. In an alternate embodiment, the low band portion and the high band portion may occupy non-overlapping frequency bands of 50 Hz-8 kHz and 8 kHz-16 kHz, respectively. In another alternate embodiment, the low band portion and the high band portion may overlap (e.g., 50 Hz-8 kHz and 7 kHz-16 kHz, respectively).

In a particular embodiment, the input signal 130 may be a wideband (WB) signal having a frequency range of approximately 50 Hz to approximately 8 kHz. In such an embodiment, the low band portion of the input signal 130 may correspond to a frequency range of approximately 50 Hz to approximately 6.4 kHz and the high band portion of the input signal 130 may correspond to a frequency range of approximately 6.4 kHz to approximately 8 kHz.

In a particular embodiment, the microphone 146 may capture the input signal 130 and an analog-to-digital converter (ADC) at the mobile device 104 may convert the captured input signal 130 from an analog waveform into a digital waveform comprised of digital audio samples. The digital audio samples may be processed by a digital signal processor. A gain adjuster may adjust a gain (e.g., of the analog waveform or the digital waveform) by increasing or decreasing an amplitude level of an audio signal (e.g., the analog waveform or the digital waveform). Gain adjusters may operate in either the analog or digital domain. For example, a gain adjuster may operate in the digital domain and may adjust the digital audio samples produced by the analog-to-digital converter. After gain adjusting, an echo canceller may reduce any echo that may have been created by an output of a speaker entering the microphone 146. The digital audio samples may be "compressed" by a vocoder (a voice encoder-decoder). The output of the echo canceller may be coupled to vocoder pre-processing blocks, e.g., filters, noise processors, rate converters, etc. An encoder of the vocoder may compress the digital audio samples and form a transmit packet (a representation of the compressed bits of the digital audio samples). In a particular embodiment, the encoder of the vocoder may include the excitation signal generation module 122. The excitation signal generation module 122 may generate a high band excitation signal 186, as described with reference to the first device 102. The excitation signal generation module 122 may provide the high band excitation signal 186 to the high band encoder 172.

The high band encoder 172 may encode a high band signal of the input signal 130 based on the high band excitation signal 186. For example, the high band encoder 172 may generate a high band bit stream 190 based on the high band excitation signal 186. The high band bit stream 190 may include high band parameter information. For example, the high band bit stream 190 may include at least one of high band linear predictive coding (LPC) coefficients, high band line spectral frequencies (LSF), high band line spectral pairs (LSP), gain shape (e.g., temporal gain parameters corresponding to sub-frames of a particular frame), gain frame (e.g., gain parameters corresponding to an energy ratio of high-band to low-band for a particular frame), or other parameters corresponding to a high band portion of the input signal 130. In a particular embodiment, the high band encoder 172 may determine the high band LPC coefficients using at least one of a vector quantizer, a hidden markov model (HMM), or a gaussian mixture model (GMM). The high band encoder 172 may determine the high band LSF, the high band LSP, or both, based on the LPC coefficients.

The high band encoder 172 may generate the high band parameter information based on the high band signal of the input signal 130. For example, a decoder of the mobile device 104 may emulate a decoder of the first device 102. The decoder of the mobile device 104 may generate a synthesized audio signal based on the high band excitation signal 186, as described with reference to the first device 102. The high band encoder 172 may generate gain values (e.g., gain shape, gain frame, or both) based on a comparison of the synthesized audio signal and the input signal 130. For example, the gain values may correspond to a difference between the synthesized audio signal and the input signal 130. The high band encoder 172 may provide the high band bit stream 190 to the MUX 174.

The MUX 174 may combine the high band bit stream 190 with a low band bit stream to generate the bit stream 132. A low band encoder of the mobile device 104 may generate the low band bit stream based on a low band signal of the input signal 130. The low band bit stream may include low band parameter information (e.g., low band LPC coefficients, low band LSF, or both) and a low band excitation signal (e.g., a low band residual of the input signal 130). The transmit packet may correspond to the bit stream 132.

The transmit packet may be stored in a memory that may be shared with a processor of the mobile device 104. The processor may be a control processor that is in communication with a digital signal processor. The mobile device 104 may transmit the bit stream 132 to the first device 102 via the network 120. For example, the transmitter 176 may modulate some form (other information may be appended to the transmit packet) of the transmit packet and send the modulated information over the air via an antenna.

The excitation signal generation module 122 of the first device 102 may receive the bit stream 132. For example, an antenna of the first device 102 may receive some form of incoming packets that comprise the transmit packet. The bit stream 132 may correspond to frames of a pulse code modulation (PCM) encoded audio signal. For example, an analog-to-digital converter (ADC) at the first device 102 may convert the bit stream 132 from an analog signal to a digital PCM signal having multiple frames.

The transmit packet may be "uncompressed" by a decoder of a vocoder at the first device 102. The uncompressed waveform (or the digital PCM signal) may be referred to as reconstructed audio samples. The reconstructed audio samples may be post-processed by vocoder post-processing blocks and may be used by an echo canceller to remove echo. For the sake of clarity, the decoder of the vocoder and the vocoder post-processing blocks may be referred to as a vocoder decoder module. In some configurations, an output of the echo canceller may be processed by the excitation signal generation module 122. Alternatively, in other configurations, the output of the vocoder decoder module may be processed by the excitation signal generation module 122.

The excitation signal generation module 122 may extract the low band parameter information, the low band excitation signal, and the high band parameter information from the bit stream 132. The voicing classifier 160 may determine a voicing classification 180 (e.g., a value from 0.0 to 1.0) indicating a voiced/unvoiced nature (e.g., strongly voiced, weakly voiced, weakly unvoiced, or strongly unvoiced) of the input signal 130, as described with reference to FIG. 2. The voicing classifier 160 may provide the voicing classification 180 to the envelope adjuster 162.

The envelope adjuster 162 may determine an envelope of a representation of the input signal 130. The envelope may be a time-varying envelope. For example, the envelope may be updated more than once per frame of the input signal 130. As another example, the envelope may be updated in response to the envelope adjuster 162 receiving each sample of the input signal 130. An extent of variation of the shape of the envelope may be greater when the voicing classification 180 corresponds to strongly voiced than when the voicing classification corresponds to strongly unvoiced. The representation of the input signal 130 may include a low band excitation signal of the input signal 130 (or of an encoded version of the input signal 130), a high band excitation signal of the input signal 130 (or of the encoded version of the input signal 130), or a harmonically extended excitation signal. For example, the excitation signal generation module 122 may generate the harmonically extended excitation signal by extending the low band excitation signal of the input signal 130 (or of the encoded version of the input signal 130).

The envelope adjuster 162 may control an amount of the envelope based on the voicing classification 180, as described with reference to FIGS. 4-7. The envelope adjuster 162 may control the amount of the envelope by controlling a characteristic (e.g., a shape, a magnitude, a gain, and/or a frequency range) of the envelope. For example, the envelope adjuster 162 may control the frequency range of the envelope based on a cut-off frequency of a filter, as described with reference to FIG. 4. The cut-off frequency may be determined based on the voicing classification 180.

As another example, the envelope adjuster 162 may control the shape of the envelope, the magnitude of the envelope, the gain of the envelope, or a combination thereof, by adjusting one or more poles of high band linear predictive coding (LPC) coefficients based on the voicing classification 180, as described with reference to FIG. 5. As a further example, the envelope adjuster 162 may control the shape of the envelope, the magnitude of the envelope, the gain of the envelope, or a combination thereof, by adjusting coefficients of a filter based on the voicing classification 180, as described with reference to FIG. 6. The characteristic of the envelope may be controlled in a transform domain (e.g., a frequency domain) or a time domain, as described with reference to FIGS. 4-6.

The envelope adjuster 162 may provide the signal envelope 182 to the modulator 164. The signal envelope 182 may correspond to the controlled amount of the envelope of the representation of the input signal 130.

The modulator 164 may use the signal envelope 182 to modulate a white noise 156 to generate the modulated white noise 184. The modulator 164 may provide the modulated white noise 184 to the output circuit 166.

The output circuit 166 may generate the high band excitation signal 186 based on the modulated white noise 184. For example, the output circuit 166 may combine the modulated white noise 184 with another signal to generate the high band excitation signal 186. In a particular embodiment, the other signal may correspond to an extended signal generated based on the low band excitation signal. For example, the output circuit 166 may generate the extended signal by upsampling the low band excitation signal, applying an absolute value function to the upsampled signal, downsampling the result of applying the absolute value function, and using adaptive whitening to spectrally flatten the downsampled signal with a linear prediction filter (e.g., a fourth order linear prediction filter). In a particular embodiment, the output circuit 166 may scale the modulated white noise 184 and the other signal based on a harmonicity parameter, as described with reference to FIGS. 4-7.

In a particular embodiment, the output circuit 166 may combine a first ratio of modulated white noise with a second ratio of unmodulated white noise to generate scaled white noise, where the first ratio and the second ratio are determined based on the voicing classification 180, as described with reference to FIG. 7. In this embodiment, the output circuit 166 may combine the scaled white noise with the other signal to generate the high band excitation signal 186. The output circuit 166 may provide the high band excitation signal 186 to the high band synthesizer 168.

The high band synthesizer 168 may generate a synthesized high band signal 188 based on the high band excitation signal 186. For example, the high band synthesizer 168 may model and/or decode the high band parameter information based on a particular high band model and may use the high band excitation signal 186 to generate the synthesized high band signal 188. The high band synthesizer 168 may provide the synthesized high band signal 188 to the MUX 170.

A low band decoder of the first device 102 may generate a synthesized low band signal. For example, the low band decoder may decode and/or model the low band parameter information based on a particular low band model and may use the low band excitation signal to generate the synthesized low band signal. The MUX 170 may combine the synthesized high band signal 188 and the synthesized low band signal to generate an output signal 116 (e.g., a decoded audio signal).

The output signal 116 may be amplified or suppressed by a gain adjuster. The first device 102 may provide the output signal 116, via the speaker 142, to the second user 154. For example, the output of the gain adjuster may be converted from a digital signal to an analog signal by a digital-to-analog converter, and played out via the speaker 142.

Thus, the system 100 may enable generation of a "smooth" sounding synthesized signal when the synthesized audio signal corresponds to an unvoiced (or strongly unvoiced) input signal. A synthesized high band signal may be generated using a noise signal that is modulated based on a voicing classification of an input signal. The modulated noise signal may correspond more closely to the input signal when the input signal is strongly voiced than when the input signal is strongly unvoiced. In a particular embodiment, the synthesized high band signal may have reduced or no sparseness when the input signal is strongly unvoiced, resulting in a smoother (e.g., having fewer artifacts) synthesized audio signal.

Figure 2:
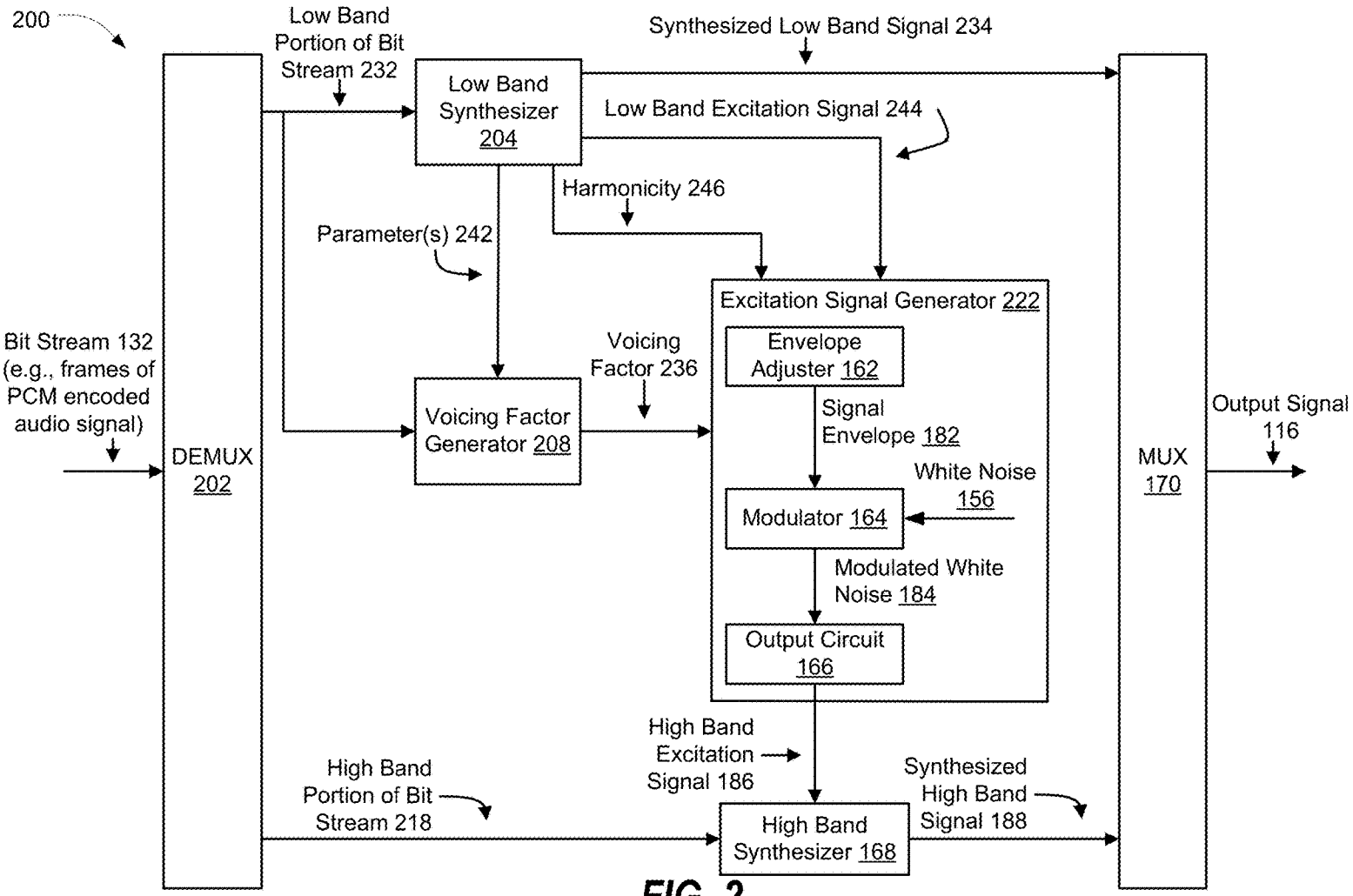
FIG. 2 is a diagram to illustrate a particular embodiment of a decoder that is operable to perform high band excitation signal generation.

Referring to FIG. 2, a particular embodiment of a decoder that is operable to perform high band excitation signal generation is disclosed and generally designated 200. In a particular embodiment, the decoder 200 may correspond to, or be included in, the system 100 of FIG. 1. For example, the decoder 200 may be included in the first device 102, the mobile device 104, or both. The decoder 200 may illustrate decoding of an encoded audio signal at a receiving device (e.g., the first device 102).

The decoder 200 includes a demultiplexer (DEMUX) 202 coupled to a low band synthesizer 204, a voicing factor generator 208, and the high band synthesizer 168. The low band synthesizer 204 and the voicing factor generator 208 may be coupled to the high band synthesizer 168 via an excitation signal generator 222. In a particular embodiment, the voicing factor generator 208 may correspond to the voicing classifier 160 of FIG. 1. The excitation signal generator 222 may be a particular embodiment of the excitation signal generation module 122 of FIG. 1. For example, the excitation signal generator 222 may include the envelope adjuster 162, the modulator 164, the output circuit 166, the voicing classifier 160, or a combination thereof. The low band synthesizer 204 and the high band synthesizer 168 may be coupled to the MUX 170.

During operation, the DEMUX 202 may receive the bit stream 132. The bit stream 132 may correspond to frames of a pulse code modulation (PCM) encoded audio signal. For example, an analog-to-digital converter (ADC) at the first device 102 may convert the bit stream 132 from an analog signal to a digital PCM signal having multiple frames. The DEMUX 202 may generate a low band portion of bit stream 232 and a high band portion of bit stream 218 from the bit stream 132. The DEMUX 202 may provide the low band portion of bit stream 232 to the low band synthesizer 204 and may provide the high band portion of bit stream 218 to the high band synthesizer 168.

The low band synthesizer 204 may extract and/or decode one or more parameters 242 (e.g., low band parameter information of the input signal 130) and a low band excitation signal 244 (e.g., a low band residual of the input signal 130) from the low band portion of bit stream 232. In a particular embodiment, the low band synthesizer 204 may extract a harmonicity parameter 246 from the low band portion of bit stream 232.

The harmonicity parameter 246 may be embedded in the low band portion of the bit stream 232 during encoding of the bit stream 232 and may correspond to a ratio of harmonic to noise energy in a high band of the input signal 130. The low band synthesizer 204 may determine the harmonicity parameter 246 based on a pitch gain value. The low band synthesizer 204 may determine the pitch gain value based on the parameters 242. In a particular embodiment, the low band synthesizer 204 may extract the harmonicity parameter 246 from the low band portion of bit stream 232. For example, the mobile device 104 may include the harmonicity parameter 246 in the bit stream 132, as described with reference to FIG. 3.

The low band synthesizer 204 may generate a synthesized low band signal 234 based on the parameters 242 and the low band excitation signal 244 using a particular low band model. The low band synthesizer 204 may provide the synthesized low band signal 234 to the MUX 170.

The voicing factor generator 208 may receive the parameters 242 from the low band synthesizer 204. The voicing factor generator 208 may generate a voicing factor 236 (e.g., a value from 0.0 to 1.0) based on the parameters 242, a previous voicing decision, one or more other factors, or a combination thereof. The voicing factor 236 may indicate a voiced/unvoiced nature (e.g., strongly voiced, weakly voiced, weakly unvoiced, or strongly unvoiced) of the input signal 130. The parameters 242 may include a zero crossing rate of a low band signal of the input signal 130, a first reflection coefficient, a ratio of energy of an adaptive codebook contribution in low band excitation to energy of a sum of adaptive codebook and fixed codebook contributions in low band excitation, pitch gain of the low band signal of the input signal 130, or a combination thereof. The voicing factor generator 208 may determine the voicing factor 236 based on Equation 1.

$$\text{Voicing Factor}=\Sigma a_i{*}p_i+c, \qquad \text{(Equation 1)}$$

where $i\in\{0, \ldots, M-1\}$, where $a_i$, and c are weights, $p_i$ corresponds to a particular measured signal parameter, and M corresponds to a number of parameters used in voicing factor determination.

In an illustrative embodiment, Voicing Factor=−0.4231*ZCR+0.2712*FR+0.0458*ACB_to_excitation+0.1849*PG+0.0138*prev_voicing_decision+0.0611, where ZCR corresponds to the zero crossing rate, FR corresponds to the first reflection coefficient, ACB_to_excitation corresponds to the ratio of energy of an adaptive codebook contribution in low band excitation to energy of a sum of adaptive codebook and fixed codebook contributions in low band excitation, PG corresponds to pitch gain, and previous_voicing_decision corresponds to another voicing factor previously computed for another frame. In a particular embodiment, the voicing factor generator 208 may use a higher threshold for classifying a frame as unvoiced than as voiced. For example, the voicing factor generator 208 may classify the frame as unvoiced if a preceding frame was classified as unvoiced and the frame has a voicing value that satisfies a first threshold (e.g., a low threshold). The voicing factor generator 208 may determine the voicing value based the zero crossing rate of the low band signal of the input signal 130, the first reflection coefficient, the ratio of energy of the adaptive codebook contribution in low band excitation to energy of the sum of adaptive codebook and fixed codebook contributions in low band excitation, the pitch gain of the low band signal of the input signal 130, or a combination thereof. Alternatively, the voicing factor generator 208 may classify the frame as unvoiced if the voicing value of the frame satisfies a second threshold (e.g., a very low threshold). In a particular embodiment, the voicing factor 236 may correspond to the voicing classification 180 of FIG. 1.

The excitation signal generator 222 may receive the low band excitation signal 244 and the harmonicity parameter 246 from the low band synthesizer 204 and may receive the voicing factor 236 from the voicing factor generator 208. The excitation signal generator 222 may generate the high band excitation signal 186 based on the low band excitation signal 244, the harmonicity parameter 246, and the voicing factor 236, as described with reference to FIGS. 1 and 4-7. For example, the envelope adjuster 162 may control an amount of an envelope of the low band excitation signal 244 based on the voicing factor 236, as described with reference to FIGS. 1 and 4-7. In a particular embodiment, the signal envelope 182 may correspond to the controlled amount of the envelope. The envelope adjuster 162 may provide the signal envelope 182 to the modulator 164.

The modulator 164 may modulate the white noise 156 using the signal envelope 182 to generate the modulated white noise 184, as described with reference to FIGS. 1 and 4-7. The modulator 164 may provide the modulated white noise 184 to the output circuit 166.

The output circuit 166 may generate the high band excitation signal 186 by combining the modulated white noise 184 and another signal, as described with reference to FIGS. 1 and 4-7. In a particular embodiment, the output circuit 166 may combine the modulated white noise 184 and the other signal based on the harmonicity parameter 246, as described with reference to FIGS. 4-7.

The output circuit 166 may provide the high band excitation signal 186 to the high band synthesizer 168. The high band synthesizer 168 may provide a synthesized high band signal 188 to the MUX 170 based on the high band excitation signal 186 and the high band portion of bit stream 218. For example, the high band synthesizer 168 may extract high band parameters of the input signal 130 from the high band portion of bit stream 218. The high band synthesizer 168 may use the high band parameters and the high band excitation signal 186 to generate the synthesized high band signal 188 based on a particular high band model. In a particular embodiment, the MUX 170 may combine the synthesized low band signal 234 and the synthesized high band signal 188 to generate the output signal 116.

The decoder 200 of FIG. 2 may thus enable generation of a "smooth" sounding synthesized signal when the synthesized audio signal corresponds to an unvoiced (or strongly unvoiced) input signal. A synthesized high band signal may be generated using a noise signal that is modulated based on a voicing classification of an input signal. The modulated noise signal may correspond more closely to the input signal when the input signal is strongly voiced than when the input signal is strongly unvoiced. In a particular embodiment, the synthesized high band signal may have reduced or no sparseness when the input signal is strongly unvoiced, resulting in a smoother (e.g., having fewer artifacts) synthesized audio signal. In addition, determining the voicing classification (or voicing factor) based on a previous voicing decision may mitigate effects of misclassification of a frame and may result in a smoother transition between voiced and unvoiced frames.

Figure 3:
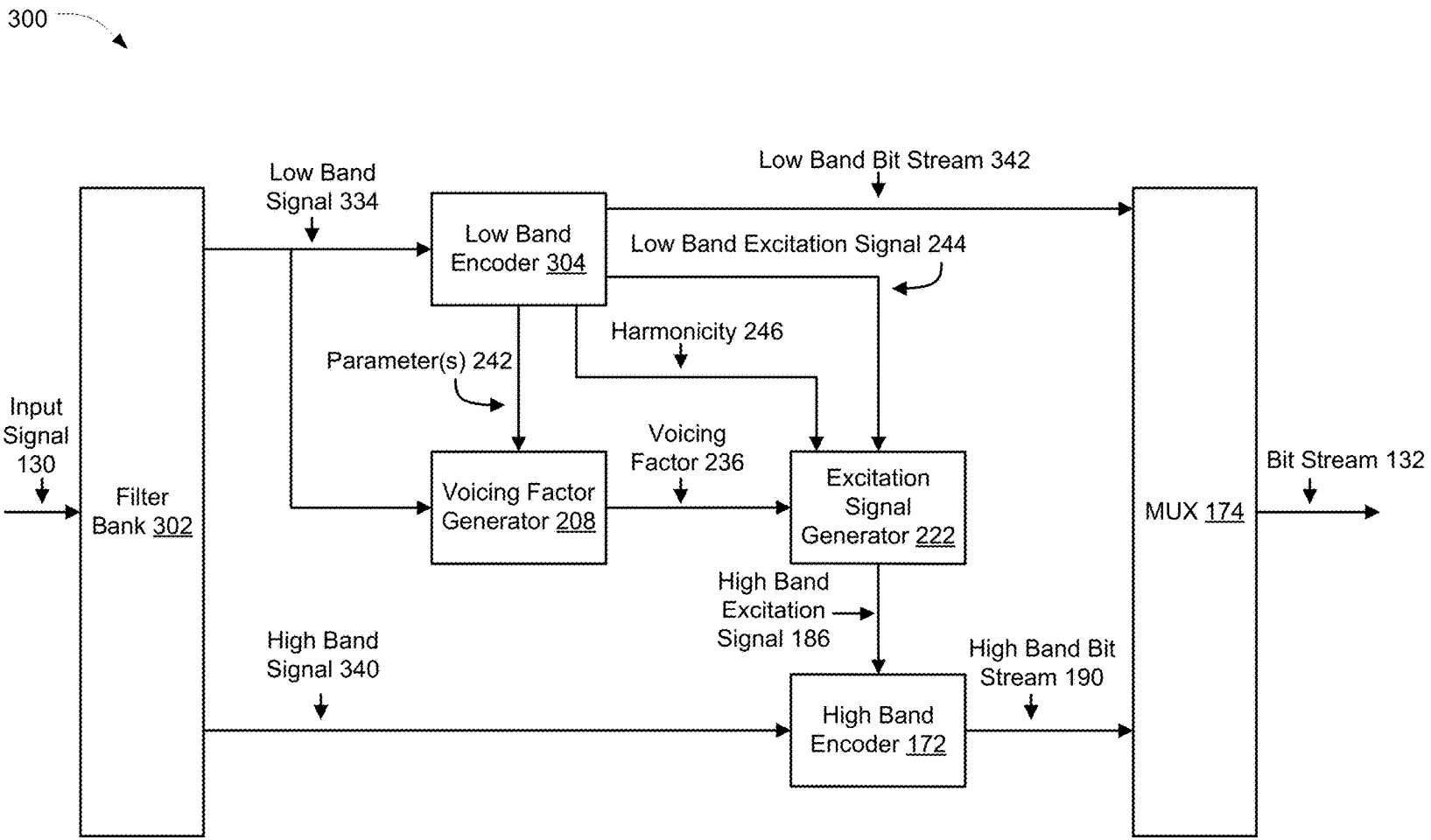
FIG. 3 is a diagram to illustrate a particular embodiment of an encoder that is operable to perform high band excitation signal generation.

Referring to FIG. 3, a particular embodiment of an encoder that is operable to perform high band excitation signal generation is disclosed and generally designated 300. In a particular embodiment, the encoder 300 may correspond to, or be included in, the system 100 of FIG. 1. For example, the encoder 300 may be included in the first device 102, the mobile device 104, or both. The encoder 300 may illustrate encoding of an audio signal at a transmitting device (e.g., the mobile device 104).

The encoder 300 includes a filter bank 302 coupled to a low band encoder 304, the voicing factor generator 208, and the high band encoder 172. The low band encoder 304 may be coupled to the MUX 174. The low band encoder 304 and the voicing factor generator 208 may be coupled to the high band encoder 172 via the excitation signal generator 222. The high band encoder 172 may be coupled to the MUX 174.

During operation, the filter bank 302 may receive the input signal 130. For example, the input signal 130 may be received by the mobile device 104 of FIG. 1 via the microphone 146. The filter bank 302 may separate the input signal 130 into multiple signals including a low band signal 334 and a high band signal 340. For example, the filter bank 302 may generate the low band signal 334 using a low-pass filter corresponding to a lower frequency sub-band (e.g., 50 Hz-7 kHz) of the input signal 130 and may generate the high band signal 340 using a high-pass filter corresponding to a higher frequency sub-band (e.g., 7 kHz-16 kHz) of the input signal 130. The filter bank 302 may provide the low band signal 334 to the low band encoder 304 and may provide the high band signal 340 to the high band encoder 172.

The low band encoder 304 may generate the parameters 242 (e.g., low band parameter information) and the low band excitation signal 244 based on the low band signal 334. For example, the parameters 242 may include low band LPC coefficients, low band LSF, low band line spectral pairs (LSP), or a combination thereof. The low band excitation signal 244 may correspond to a low band residual signal. The low band encoder 304 may generate the parameters 242 and the low band excitation signal 244 based on a particular low band model (e.g., a particular linear prediction model). For example, the low band encoder 304 may generate the parameters 242 (e.g., filter coefficients corresponding to formants) of the low band signal 334, may inverse-filter the low band signal 334 based on the parameters 242, and may subtract the inverse-filtered signal from the low band signal 334 to generate the low band excitation signal 244 (e.g., the low band residual signal of the low band signal 334). The low band encoder 304 may generate the low band bit stream 342 including the parameters 242 and the low band excitation signal 244. In a particular embodiment, the low band bit stream 342 may include the harmonicity parameter 246. For example, the low band encoder 304 may determine the harmonicity parameter 246, as described with reference to the low band synthesizer 204 of FIG. 2.

The low band encoder 304 may provide the parameters 242 to the voicing factor generator 208 and may provide the low band excitation signal 244 and the harmonicity parameter 246 to the excitation signal generator 222. The voicing factor generator 208 may determine the voicing factor 236 based on the parameters 242, as described with reference to FIG. 2. The excitation signal generator 222 may determine the high band excitation signal 186 based on the low band excitation signal 244, the harmonicity parameter 246, and the voicing factor 236, as described with reference to FIGS. 2 and 4-7.

The excitation signal generator 222 may provide the high band excitation signal 186 to the high band encoder 172. The high band encoder 172 may generate the high band bit stream 190 based on the high band signal 340 and the high band excitation signal 186, as described with reference to FIG. 1. The high band encoder 172 may provide the high band bit stream 190 to the MUX 174. The MUX 174 may combine the low band bit stream 342 and the high band bit stream 190 to generate the bit stream 132.

The encoder 300 may thus enable emulation of a decoder at a receiving device that generates a synthesized audio signal using a noise signal that is modulated based on a voicing classification of an input signal. The encoder 300 may generate high band parameters (e.g., gain values) that are used to generate the synthesized audio signal to closely approximate the input signal 130.

FIGS. 4-7 are diagrams to illustrate particular embodiments of methods of high band excitation signal generation. Each of the methods of FIGS. 4-7 may be performed by one or more components of the systems 100-300 of FIGS. 1-3. For example, each of the methods of FIGS. 4-7 may be performed by one or more components of the high band excitation signal generation module 122 of FIG. 1, the excitation signal generator 222 of FIG. 2 and/or FIG. 3, the voicing factor generator 208 of FIG. 2, or a combination thereof. FIGS. 4-7 illustrate alternative embodiments of methods of generating a high band excitation signal represented in a transform domain, in a time domain, or either in the transform domain or the time domain.

Figure 4:
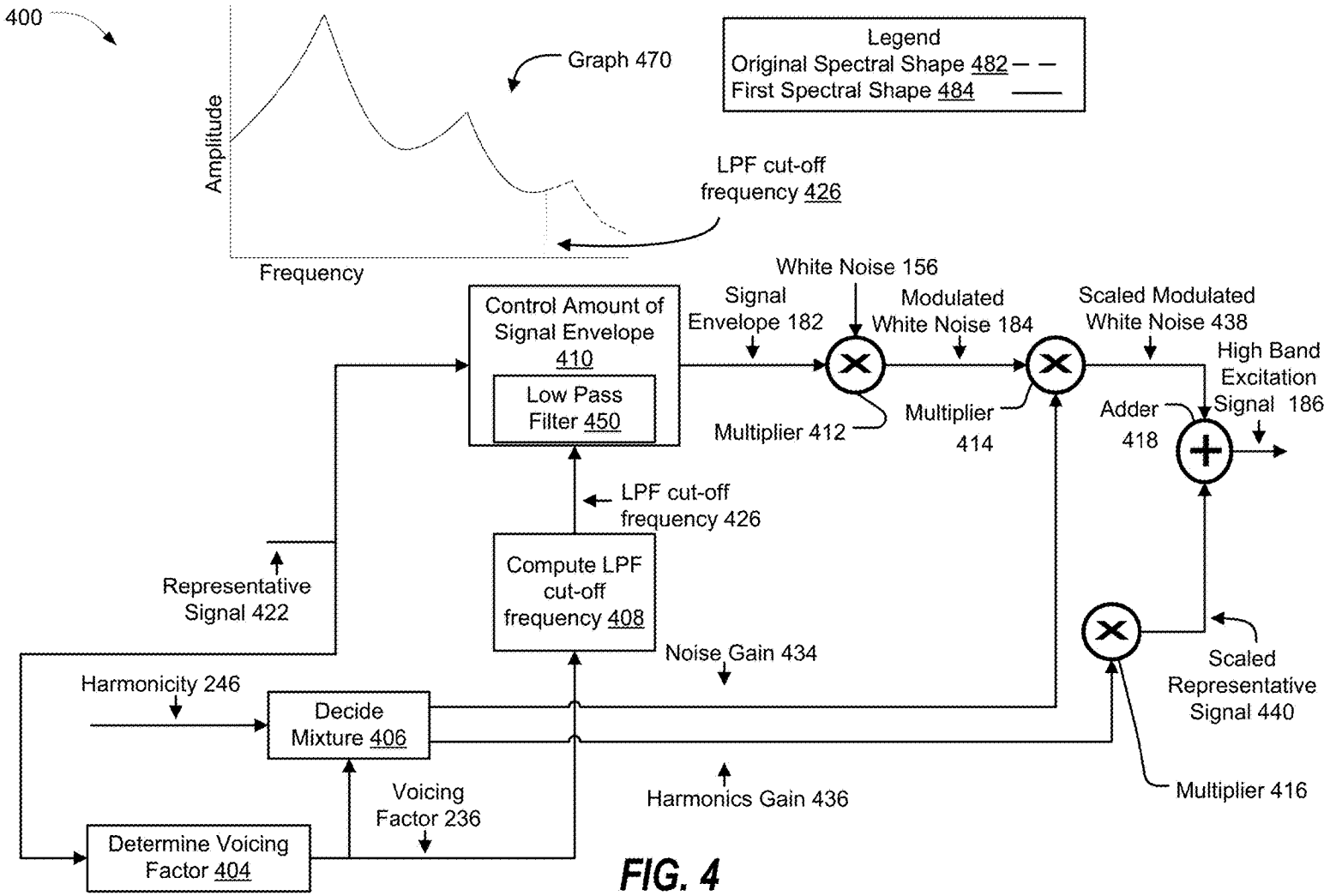
FIG. 4 is a diagram to illustrate a particular embodiment of a method of high band excitation signal generation.

Referring to FIG. 4, a diagram of a particular embodiment of a method of high band excitation signal generation is shown and generally designated 400. The method 400 may correspond to generating a high band excitation signal represented in either a transform domain or a time domain.

The method 400 includes determining a voicing factor, at 404. For example, the voicing factor generator 208 of FIG. 2 may determine the voicing factor 236 based on a representative signal 422. In a particular embodiment, the voicing factor generator 208 may determine the voicing factor 236 based on one or more other signal parameters. In a particular embodiment, several signal parameters may work in combination to determine the voicing factor 236. For example, the voicing factor generator 208 may determine the voicing factor 236 based on the low band portion of bit stream 232 (or the low band signal 334 of FIG. 3), the parameters 242, a previous voicing decision, one or more other factors, or a combination thereof, as described with reference to FIGS. 2-3. The representative signal 422 may include the low band portion of the bit stream 232, the low band signal 334, or an extended signal generated by extending the low band excitation signal 244. The representative signal 422 may be represented in a transform (e.g., frequency) domain or a time domain. For example, the excitation signal generation module 122 may generate the representative signal 422 by applying a transform (e.g., a Fourier transform) to the input signal 130, the bit stream 132 of FIG. 1, the low band portion of bit stream 232, the low band signal 334, the extended signal generated by extending the low band excitation signal 244 of FIG. 2, or a combination thereof.

The method 400 also includes computing a low pass filter (LPF) cut-off frequency, at 408, and controlling an amount of signal envelope, at 410. For example, the envelope adjuster 162 of FIG. 1 may compute a LPF cut-off frequency 426 based on the voicing factor 236. If the voicing factor 236 indicates strongly voiced audio, the LPF cut-off frequency 426 may be higher indicating a higher influence of a harmonic component of a temporal envelope. When the voicing factor 236 indicates strongly unvoiced audio, the LPF cut-off frequency 426 may be lower corresponding to lower (or no) influence of the harmonic component of the temporal envelope.

The envelope adjuster 162 may control the amount of the signal envelope 182 by controlling a characteristic (e.g., a frequency range) of the signal envelope 182. For example, the envelope adjuster 162 may control the characteristic of the signal envelope 182 by applying a low pass filter 450 to the representative signal 422. A cut-off frequency of the low pass filter 450 may be substantially equal to the LPF cut-off frequency 426. The envelope adjuster 162 may control the frequency range of the signal envelope 182 by tracking a temporal envelope of the representative signal 422 based on the LPF cut-off frequency 426. For example, the low pass filter 450 may filter the representative signal 422 such that the filtered signal has a frequency range defined by the LPF cut-off frequency 426. To illustrate, the frequency range of the filtered signal may be below the LPF cut-off frequency 426. In a particular embodiment, the filtered signal may have an amplitude that matches an amplitude of the representative signal 422 below the LPF cut-off frequency 426 and may have a low amplitude (e.g., substantially equal to 0) above the LPF cut-off frequency 426.

A graph 470 illustrates an original spectral shape 482. The original spectral shape 482 may represent the signal envelope 182 of the representative signal 422. A first spectral shape 484 may correspond to the filtered signal generated by applying the filter having the LPF cut-off frequency 426 to the representative signal 422.

The LPF cut-off frequency 426 may determine a tracking speed. For example, the temporal envelope may be tracked faster (e.g., more frequently updated) when the voicing factor 236 indicates voiced than when the voicing factor 236 indicates unvoiced. In a particular embodiment, the envelope adjuster 162 may control the characteristic of the signal envelope 182 in the time domain. For example, the envelope adjuster 162 may control the characteristic of the signal envelope 182 sample by sample. In an alternative embodiment, the envelope adjuster 162 may control the characteristic of the signal envelope 182 represented in the transform domain. For example, the envelope adjuster 162 may control the characteristic of the signal envelope 182 by tracking a spectral shape based on the tracking speed. The envelope adjuster 162 may provide the signal envelope 182 to the modulator 164 of FIG. 1.

The method 400 further includes multiplying the signal envelope 182 with white noise 156, at 412. For example, the modulator 164 of FIG. 1 may use the signal envelope 182 to modulate the white noise 156 to generate the modulated white noise 184. The signal envelope 182 may modulate the white noise 156 represented in a transform domain or a time domain.

The method 400 also includes deciding a mixture, at 406. For example, the modulator 164 of FIG. 1 may determine a first gain (e.g., noise gain 434) to be applied to the modulated white noise 184 and a second gain (e.g., harmonics gain 436) to be applied to the representative signal 422 based on the harmonicity parameter 246 and the voicing factor 236. For example, the noise gain 434 (e.g., between 0 and 1) and the harmonics gain 436 may be computed to match the ratio of harmonic to noise energy indicated by the harmonicity parameter 246. The modulator 164 may increase the noise gain 434 when the voicing factor 236 indicates strongly unvoiced and may reduce the noise gain 434 when the voicing factor 236 indicates strongly voiced. In a particular embodiment, the modulator 164 may determine the harmonics gain 436 based on the noise gain 434. In a particular embodiment, $$\text{harmonics gain } 436=\sqrt{1-(\text{noisegain}434)^2}.$$

The method 400 further includes multiplying the modulated white noise 184 and the noise gain 434, at 414. For example, the output circuit 166 of FIG. 1 may generate scaled modulated white noise 438 by applying the noise gain 434 to the modulated white noise 184.

The method 400 also includes multiplying the representative signal 422 and the harmonics gain 436, at 416. For example, the output circuit 166 of FIG. 1 may generate scaled representative signal 440 by applying the harmonics gain 436 to the representative signal 422.

The method 400 further includes adding the scaled modulated white noise 438 and the scaled representative signal 440, at 418. For example, the output circuit 166 of FIG. 1 may generate the high band excitation signal 186 by combining (e.g., adding) the scaled modulated white noise 438 and the scaled representative signal 440. In alternative embodiments, the operation 414, the operation 416, or both, may be performed by the modulator 164 of FIG. 1. The high band excitation signal 186 may be in the transform domain or the time domain.

Thus, the method 400 may enable an amount of signal envelope to be controlled by controlling a characteristic of the envelope based on the voicing factor 236. In a particular embodiment, the proportion of the modulated white noise 184 and the representative signal 422 may be dynamically determined by gain factors (e.g., the noise gain 434 and the harmonics gain 436) based on the harmonicity parameter 246. The modulated white noise 184 and the representative signal 422 may be scaled such that a ratio of harmonic to noise energy of the high band excitation signal 186 approximates the ratio of harmonic to noise energy of the high band signal of the input signal 130.

In particular embodiments, the method 400 of FIG. 4 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 400 of FIG. 4 can be performed by a processor that executes instructions, as described with respect to FIG. 9.

Figure 5:
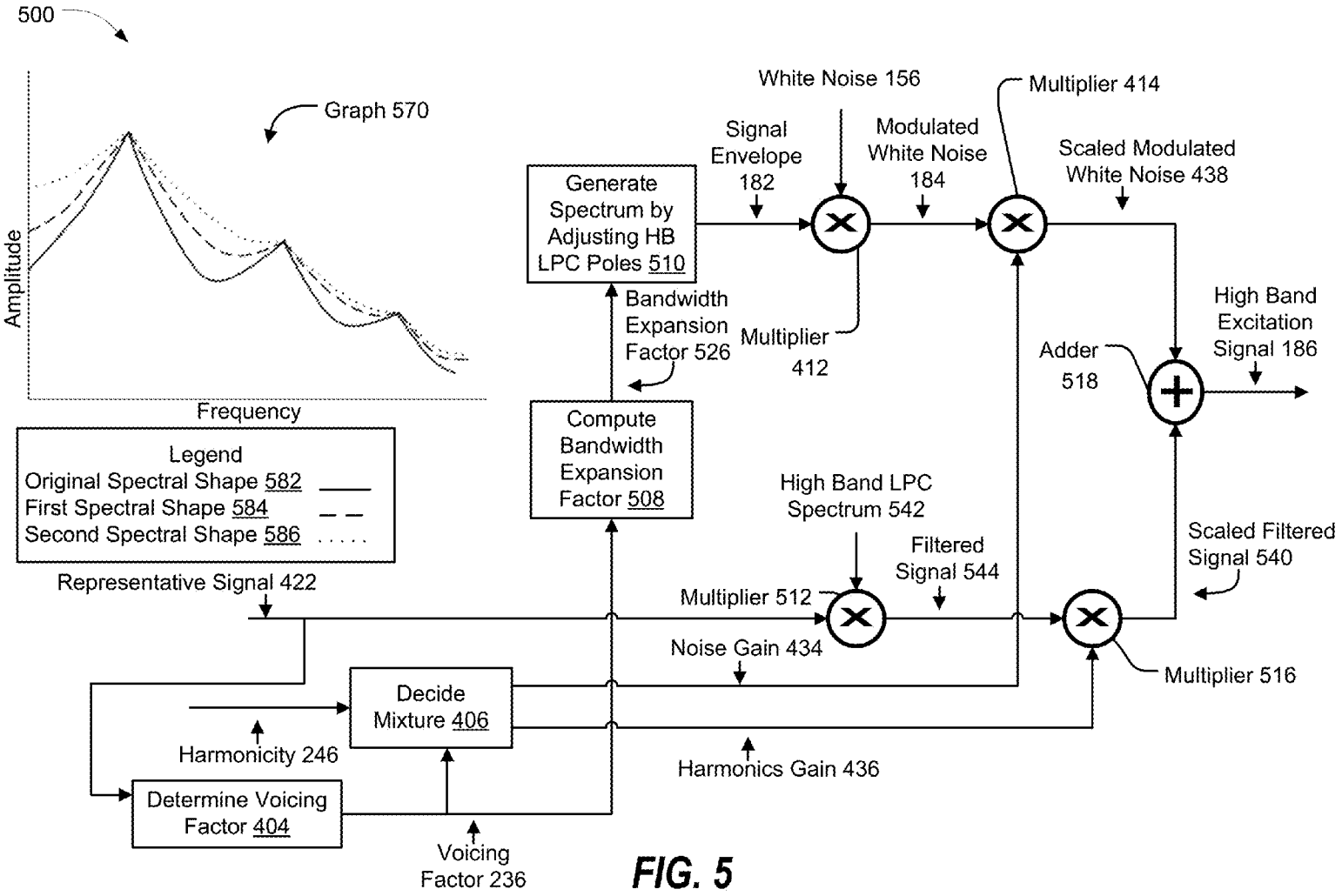
FIG. 5 is a diagram to illustrate another embodiment of a method of high band excitation signal generation.

Referring to FIG. 5, a diagram of a particular embodiment of a method of high band excitation signal generation is shown and generally designated 500. The method 500 may include generating the high band excitation signal by controlling an amount of a signal envelope represented in a transform domain, modulating white noise represented in a transform domain, or both.

The method 500 includes operations 404, 406, 412, and 414 of the method 400. The representative signal 422 may be represented in a transform (e.g., frequency) domain, as described with reference to FIG. 4.

The method 500 also includes computing a bandwidth expansion factor, at 508. For example, the envelope adjuster 162 of FIG. 1 may determine a bandwidth expansion factor 526 based on the voicing factor 236. For example, the bandwidth expansion factor 526 may indicate greater bandwidth expansion when the voicing factor 236 indicates strongly voiced than when the voicing factor 236 indicates strongly unvoiced.

The method 500 further includes generating a spectrum by adjusting high band LPC poles, at 510. For example, the envelope adjuster 162 may determine LPC poles associated with the representative signal 422. The envelope adjuster 162 may control a characteristic of the signal envelope 182 by controlling a magnitude of the signal envelope 182, a shape of the signal envelope 182, a gain of the signal envelope 182, or a combination thereof. For example, the envelope adjuster 162 may control the magnitude of the signal envelope 182, the shape of the signal envelope 182, the gain of the signal envelope 182, or a combination thereof, by adjusting the LPC poles based on the bandwidth expansion factor 526. In a particular embodiment, the LPC poles may be adjusted in a transform domain. The envelope adjuster 162 may generate a spectrum based on the adjusted LPC poles.

A graph 570 illustrates an original spectral shape 582. The original spectral shape 582 may represent the signal envelope 182 of the representative signal 422. The original spectral shape 582 may be generated based on the LPC poles associated with the representative signal 422. The envelope adjuster 162 may adjust the LPC poles based on the voicing factor 236. The envelope adjuster 162 may apply a filter corresponding to the adjusted LPC poles to the representative signal 422 to generate a filtered signal having a first spectral shape 584 or a second spectral shape 586. The first spectral shape 584 of the filtered signal may correspond to the adjusted LPC poles when the voicing factor 236 indicates strongly voiced. The second spectral shape 586 of the filtered signal may correspond to the adjusted LPC poles when the voicing factor 236 indicates strongly unvoiced.

The signal envelope 182 may correspond to the generated spectrum, the adjusted LPC poles, LPC coefficients associated with the representative signal 422 having the adjusted LPC poles, or a combination thereof. The envelope adjuster 162 may provide the signal envelope 182 to the modulator 164 of FIG. 1.

The modulator 164 may modulate the white noise 156 using the signal envelope 182 to generate the modulated white noise 184, as described with reference to the operation 412 of the method 400. The modulator 164 may modulate the white noise 156 represented in a transform domain. The output circuit 166 of FIG. 1 may generate the scaled modulated white noise 438 based on the modulated white noise 184 and the noise gain 434, as described with reference to the operation 414 of the method 400.

The method 500 also includes multiplying a high band LPC spectrum 542 and the representative signal 422, at 512. For example, the output circuit 166 of FIG. 1 may filter the representative signal 422 using the high band LPC spectrum 542 to generate a filtered signal 544. In a particular embodiment, the output circuit 166 may determine the high band LPC spectrum 542 based on high band parameters (e.g., high band LPC coefficients) associated with the representative signal 422. To illustrate, the output circuit 166 may determine the high band LPC spectrum 542 based on the high band portion of bit stream 218 of FIG. 2 or based on high band parameter information generated from the high band signal 340 of FIG. 3.

The representative signal 422 may correspond to an extended signal generated from the low band excitation signal 244 of FIG. 2. The output circuit 166 may synthesize the extended signal using the high band LPC spectrum 542 to generate the filtered signal 544. The synthesis may be in the transform domain. For example, the output circuit 166 may perform the synthesis using multiplication in the frequency domain.

The method 500 further includes multiplying the filtered signal 544 and the harmonics gain 436, at 516. For example, the output circuit 166 of FIG. 1 may multiply the filtered signal 544 with the harmonics gain 436 to generate a scaled filtered signal 540. In a particular embodiment, the operation 512, the operation 516, or both, may be performed by the modulator 164 of FIG. 1.

The method 500 also includes adding the scaled modulated white noise 438 and the scaled filtered signal 540, at 518. For example, the output circuit 166 of FIG. 1 may combine the scaled modulated white noise 438 and the scaled filtered signal 540 to generate the high band excitation signal 186. The high band excitation signal 186 may be represented in the transform domain.

Thus, the method 500 may enable an amount of signal envelope to be controlled by adjusting high band LPC poles in the transform domain based on the voicing factor 236. In a particular embodiment, the proportion of the modulated white noise 184 and the filtered signal 544 may be dynamically determined by gains (e.g., the noise gain 434 and the harmonic gain 436) based on the harmonicity parameter 246. The modulated white noise 184 and the filtered signal 544 may be scaled such that a ratio of harmonic to noise energy of the high band excitation signal 186 approximates the ratio of harmonic to noise energy of the high band signal of the input signal 130.

In particular embodiments, the method 500 of FIG. 5 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 500 of FIG. 5 can be performed by a processor that executes instructions, as described with respect to FIG. 9.

Figure 6:
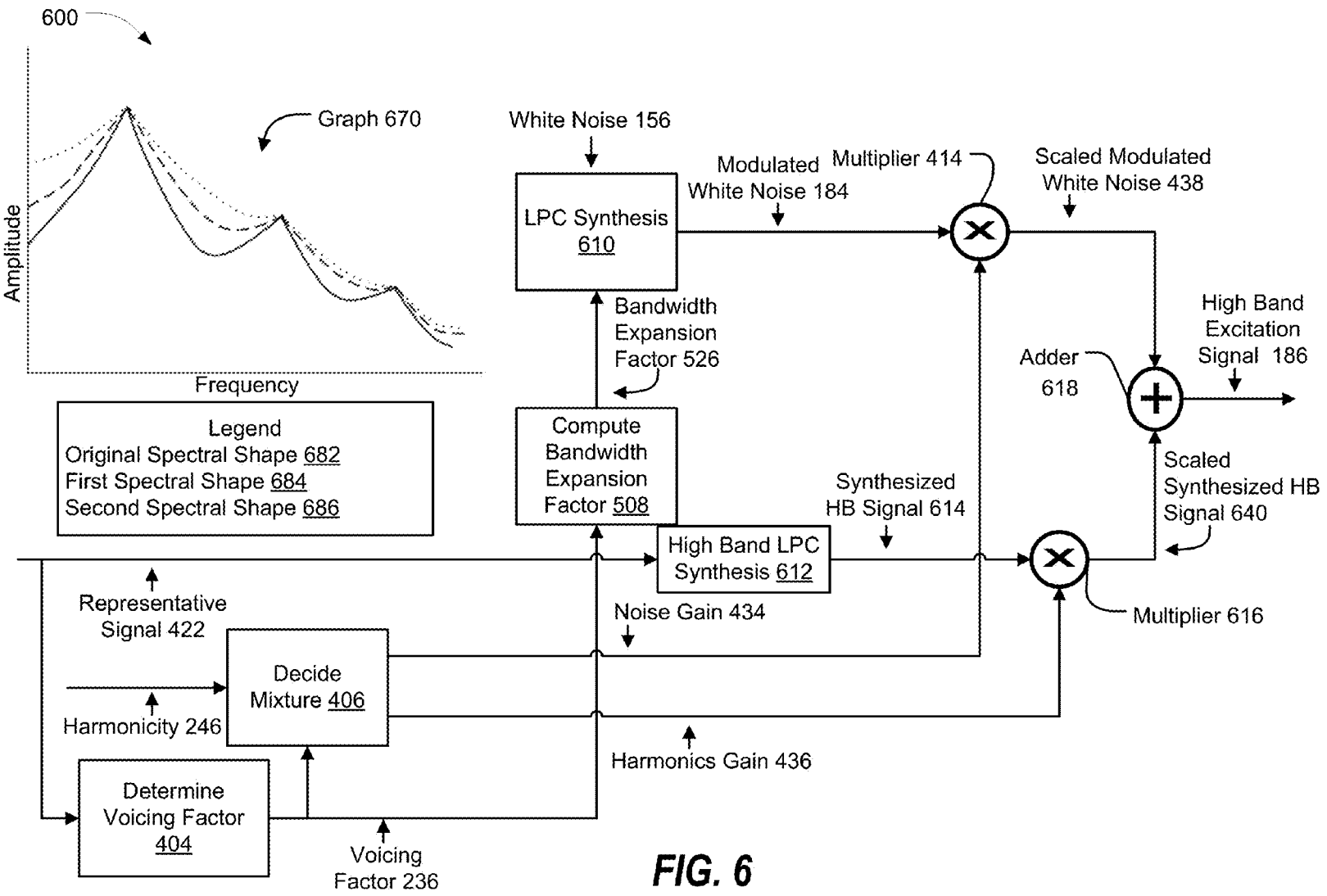
FIG. 6 is a diagram to illustrate another embodiment of a method of high band excitation signal generation.

Referring to FIG. 6, a diagram of a particular embodiment of a method of high band excitation signal generation is shown and generally designated 600. The method 600 may include generating a high band excitation signal by controlling an amount of a signal envelope in a time domain.

The method 600 includes operations 404, 406, and 414 of method 400 and operation 508 of method 500. The representative signal 422 and the white noise 156 may be in a time domain.

The method 600 also includes performing LPC synthesis, at 610. For example, the envelope adjuster 162 of FIG. 1 may control a characteristic (e.g., a shape, a magnitude, and/or a gain) of the signal envelope 182 by adjusting coefficients of a filter based on the bandwidth expansion factor 526. In a particular embodiment, the LPC synthesis may be performed in a time domain. The coefficients of the filter may correspond to high band LPC coefficients. The LPC filter coefficients may represent spectral peaks. Controlling the spectral peaks by adjusting the LPC filter coefficients may enable control of an extent of modulation of the white noise 156 based on the voicing factor 236.

For example, the spectral peaks may be preserved when the voicing factor 236 indicates voiced speech. As another example, the spectral peaks may be smoothed while preserving an overall spectral shape when the voicing factor 236 indicates unvoiced speech.

A graph 670 illustrates an original spectral shape 682. The original spectral shape 682 may represent the signal envelope 182 of the representative signal 422. The original spectral shape 682 may be generated based on the LPC filter coefficients associated with the representative signal 422. The envelope adjuster 162 may adjust the LPC filter coefficients based on the voicing factor 236. The envelope adjuster 162 may apply a filter corresponding to the adjusted LPC filter coefficients to the representative signal 422 to generate a filtered signal having a first spectral shape 684 or a second spectral shape 686. The first spectral shape 684 of the filtered signal may correspond to the adjusted LPC filter coefficients when the voicing factor 236 indicates strongly voiced. Spectral peaks may be preserved when the voicing factor 236 indicates strongly voiced, as illustrated by the first spectral shape 684. The second spectral shape 686 may correspond to the adjusted LPC filter coefficients when the voicing factor 236 indicates strongly unvoiced. An overall spectral shape may be preserved while the spectral peaks may be smoothed when the voicing factor 236 indicates strongly unvoiced, as illustrated by the second spectral shape 686. The signal envelope 182 may correspond to the adjusted filter coefficients. The envelope adjuster 162 may provide the signal envelope 182 to the modulator 164 of FIG. 1.

The modulator 164 may modulate the white noise 156 using signal envelope 182 (e.g., the adjusted filter coefficients) to generate the modulated white noise 184. For example, the modulator 164 may apply a filter to the white noise 156 to generate the modulated white noise 184, where the filter has the adjusted filter coefficients. The modulator 164 may provide the modulated white noise 184 to the output circuit 166 of FIG. 1. The output circuit 166 may multiply the modulated white noise 184 with the noise gain 434 to generate the scaled modulated white noise 438, as described with reference to the operation 414 of FIG. 4.

The method 600 further includes performing high band LPC synthesis, at 612. For example, the output circuit 166 of FIG. 1 may synthesize the representative signal 422 to generate a synthesized high band signal 614. The synthesis may be performed in the time domain. In a particular embodiment, the representative signal 422 may be generated by extending a low band excitation signal. The output circuit 166 may generate the synthesized high band signal 614 by applying a synthesis filter using high band LPCs to the representative signal 422.

The method 600 also includes multiplying the synthesized high band signal 614 and the harmonics gain 436, at 616. For example, the output circuit 166 of FIG. 1 may apply the harmonics gain 436 to the synthesized high band signal 614 to generate the scaled synthesized high band signal 640. In an alternative embodiment, the modulator 164 of FIG. 1 may perform the operation 612, the operation 616, or both.

The method 600 further includes adding the scaled modulated white noise 438 and the scaled synthesized high band signal 640, at 618. For example, the output circuit 166 of FIG. 1 may combine the scaled modulated white noise 438 and the scaled synthesized high band signal 640 to generate the high band excitation signal 186.

Thus, the method 600 may enable an amount of signal envelope to be controlled by adjusting coefficients of a filter based on the voicing factor 236. In a particular embodiment, the proportion of the modulated white noise 184 and the synthesized high band signal 614 may be dynamically determined based on the voicing factor 236. The modulated white noise 184 and the synthesized high band signal 614 may be scaled such that a ratio of harmonic to noise energy of the high band excitation signal 186 approximates the ratio of harmonic to noise energy of the high band signal of the input signal 130.

In particular embodiments, the method 600 of FIG. 6 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 600 of FIG. 6 can be performed by a processor that executes instructions, as described with respect to FIG. 9.

Figure 7:
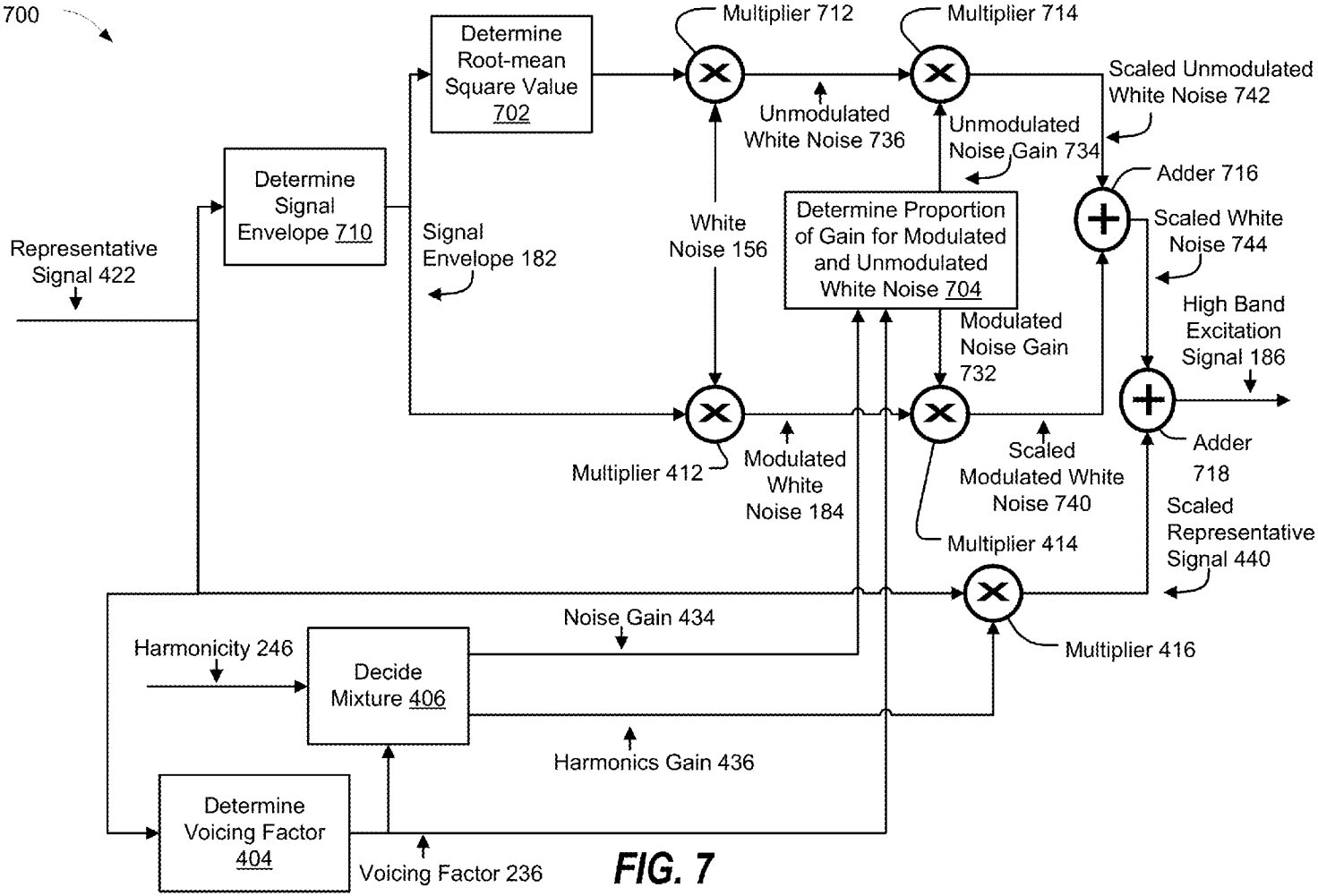
FIG. 7 is a diagram to illustrate another embodiment of a method of high band excitation signal generation.

Referring to FIG. 7, a diagram of a particular embodiment of a method of high band excitation signal generation is shown and generally designated 700. The method 700 may correspond to generating a high band excitation signal by controlling an amount of signal envelope represented in a time domain or a transform (e.g., frequency) domain.

The method 700 includes operations 404, 406, 412, 414, and 416 of method 400. The representative signal 422 may be represented in a transform domain or a time domain. The method 700 also includes determining a signal envelope, at 710. For example, the envelope adjuster 162 of FIG. 1 may generate the signal envelope 182 by applying a low pass filter to the representative signal 422 with a constant coefficient.

The method 700 also includes determining a root-mean square value, at 702. For example, the modulator 164 of FIG. 1 may determine a root-mean square energy of the signal envelope 182.

The method 700 further includes multiplying the root-mean square value with the white noise 156, at 712. For example, the output circuit 166 of FIG. 1 may multiply the root-mean square value with the white noise 156 to generate unmodulated white noise 736.

The modulator 164 of FIG. 1 may multiply the signal envelope 182 with the white noise 156 to generate modulated white noise 184, as described with reference to the operation 412 of the method 400. The white noise 156 may be represented in a transform domain or a time domain.

The method 700 also includes determining a proportion of gain for modulated and unmodulated white noise, at 704. For example, the output circuit 166 of FIG. 1 may determine an unmodulated noise gain 734 and a modulated noise gain 732 based on the noise gain 434 and the voicing factor 236. If the voicing factor 236 indicates that the encoded audio signal corresponds to strongly voiced audio, the modulated noise gain 732 may correspond to a higher proportion of the noise gain 434. If the voicing factor 236 indicates that the encoded audio signal corresponds to strongly unvoiced audio, the unmodulated noise gain 734 may correspond to a higher proportion of the noise gain 434.

The method 700 further includes multiplying the unmodulated noise gain 734 and the unmodulated white noise 736, at 714. For example, the output circuit 166 of FIG. 1 may apply the unmodulated noise gain 734 to the unmodulated white noise 736 to generate scaled unmodulated white noise 742.

The output circuit 166 may apply the modulated noise gain 732 to the modulated white noise 184 to generate scaled modulated white noise 740, as described with reference to the operation 414 of the method 400.

The method 700 also includes adding the scaled unmodulated white noise 742 and the scaled white noise 744, at 716. For example, the output circuit 166 of FIG. 1 may combine the scaled unmodulated white noise 742 and the scaled modulated white noise 740 to generate scaled white noise 744.

The method 700 further includes adding the scaled white noise 744 and the scaled representative signal 440, at 718. For example, the output circuit 166 may combine the scaled white noise 744 and the scaled representative signal 440 to generate the high band excitation signal 186. The method 700 may generate the high band excitation signal 186 represented in a transform (or time) domain using the representative signal 422 and the white noise 156 represented in the transform (or time) domain.

Thus, the method 700 may enable a proportion of the unmodulated white noise 736 and the modulated white noise 184 to be dynamically determined by gain factors (e.g., the unmodulated noise gain 734 and the modulated noise gain 732) based on the voicing factor 236. The high band excitation signal 186 for strongly unvoiced audio may correspond to unmodulated white noise with fewer artifacts than a high band signal corresponding to white noise modulated based on a sparsely coded low band residual.

In particular embodiments, the method 700 of FIG. 7 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 700 of FIG. 7 can be performed by a processor that executes instructions, as described with respect to FIG. 9.

Figure 8:
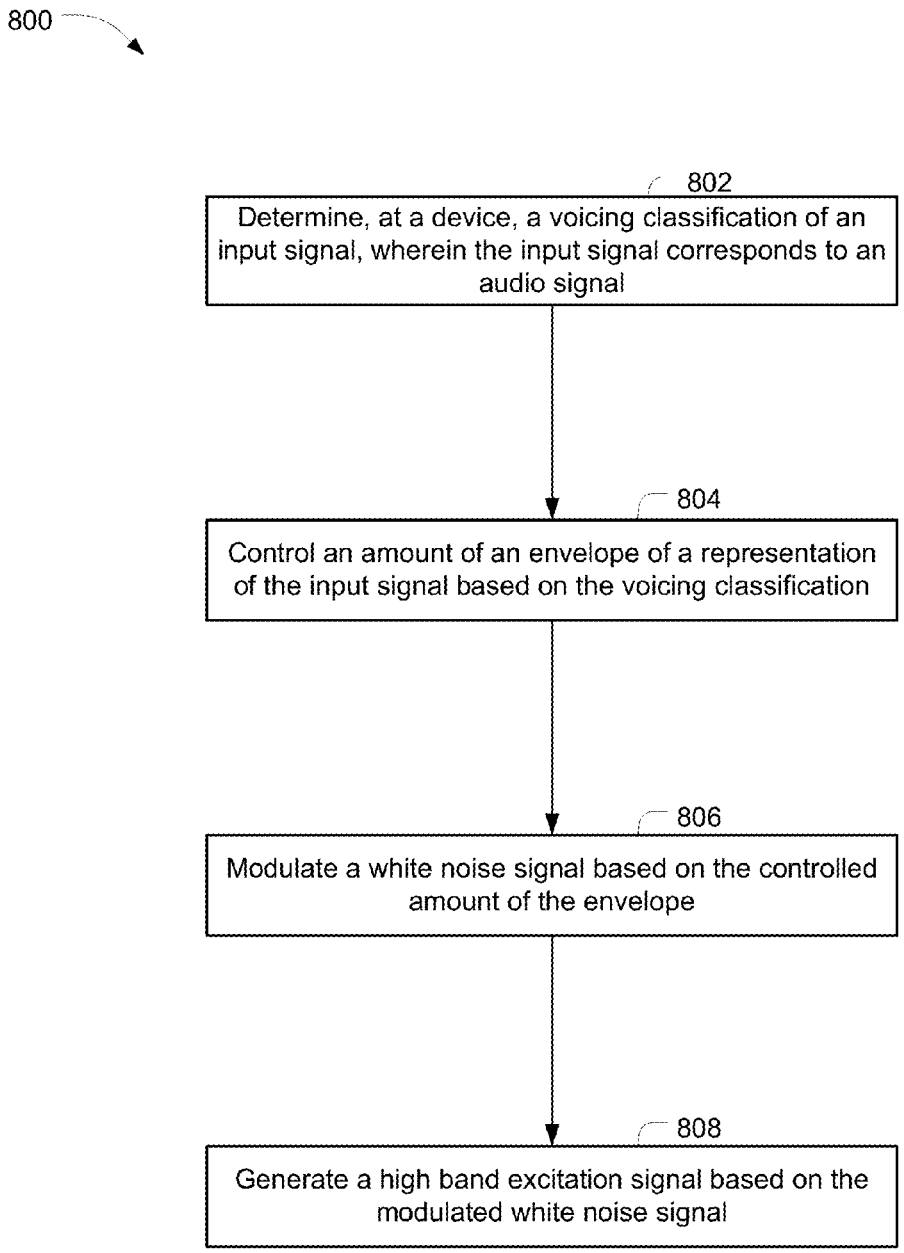
FIG. 8 is a flowchart to illustrate another embodiment of a method of high band excitation signal generation.

Referring to FIG. 8, a flowchart of a particular embodiment of a method of high band excitation signal generation is shown and generally designated 800. The method 800 may be performed by one or more components of the systems 100-300 of FIGS. 1-3. For example, the method 800 may be performed by one or more components of the high band excitation signal generation module 122 of FIG. 1, the excitation signal generator 222 of FIG. 2 or FIG. 3, the voicing factor generator 208 of FIG. 2, or a combination thereof.

The method 800 includes determining, at a device, a voicing classification of an input signal, at 802. The input signal may correspond to an audio signal. For example, the voicing classifier 160 of FIG. 1 may determine the voicing classification 180 of the input signal 130, as described with reference to FIG. 1. The input signal 130 may correspond to an audio signal.

The method 800 also includes controlling an amount of an envelope of a representation of the input signal based on the voicing classification, at 804. For example, the envelope adjuster 162 of FIG. 1 may control an amount of an envelope of a representation of the input signal 130 based on the voicing classification 180, as described with reference to FIG. 1. The representation of the input signal 130 may be a low band portion of a bit stream (e.g., the bit stream 232 of FIG. 2), a low band signal (e.g., the low band signal 334 of FIG. 3), an extended signal generated by extending a low band excitation signal (e.g., the low band excitation signal 244 of FIG. 2), another signal, or a combination thereof. For example, the representation of the input signal 130 may include the representative signal 422 of FIGS. 4-7.

The method 800 further includes modulating a white noise signal based on the controlled amount of the envelope, at 806. For example, the modulator 164 of FIG. 1 may modulate the white noise 156 based on the signal envelope 182. The signal envelope 182 may correspond to the controlled amount of the envelope. To illustrate, the modulator 164 may modulate the white noise 156 in a time domain, such as in FIGS. 4 and 6-7. Alternatively, the modulator 164 may modulate the white noise 156 represented in a transform domain, such as in FIGS. 4-7.

The method 800 also includes generating a high band excitation signal based on the modulated white noise signal, at 808. For example, the output circuit 166 of FIG. 1 may generate the high band excitation signal 186 based on the modulated white noise 184, as described with reference to FIG. 1.

The method 800 of FIG. 8 may thus enable generation of a high band excitation signal based on a controlled amount of an envelope of an input signal, where the amount of the envelope is controlled based on a voicing classification.

In particular embodiments, the method 800 of FIG. 8 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 800 of FIG. 8 can be performed by a processor that executes instructions, as described with respect to FIG. 9.

Although the embodiments of FIGS. 1-8 describe generating a high band excitation signal based on a low band signal, in other embodiments the input signal 130 may be filtered to produce multiple band signals. For example, the multiple band signals may include a lower band signal, a medium band signal, a higher band signal, one or more additional band signals, or a combination thereof. The medium band signal may correspond to a higher frequency range than the lower band signal and the higher band signal may correspond to a higher frequency range than the medium band signal. The lower band signal and the medium band signal may correspond to overlapping or non-overlapping frequency ranges. The medium band signal and the higher band signal may correspond to overlapping or non-overlapping frequency ranges.

The excitation signal generation module 122 may use a first band signal (e.g., the lower band signal or the medium band signal) to generate an excitation signal corresponding to a second band signal (e.g., the medium band signal or the higher band signal), where the first band signal corresponds to a lower frequency range than the second band signal.

In a particular embodiment, the excitation signal generation module 122 may use a first band signal to generate multiple excitation signals corresponding to multiple band signals. For example, the excitation signal generation module 122 may use the lower band signal to generate a medium band excitation signal corresponding to the medium band signal, a higher band excitation signal corresponding to the higher band signal, one or more additional band excitation signals, or a combination thereof.

Figure 9:
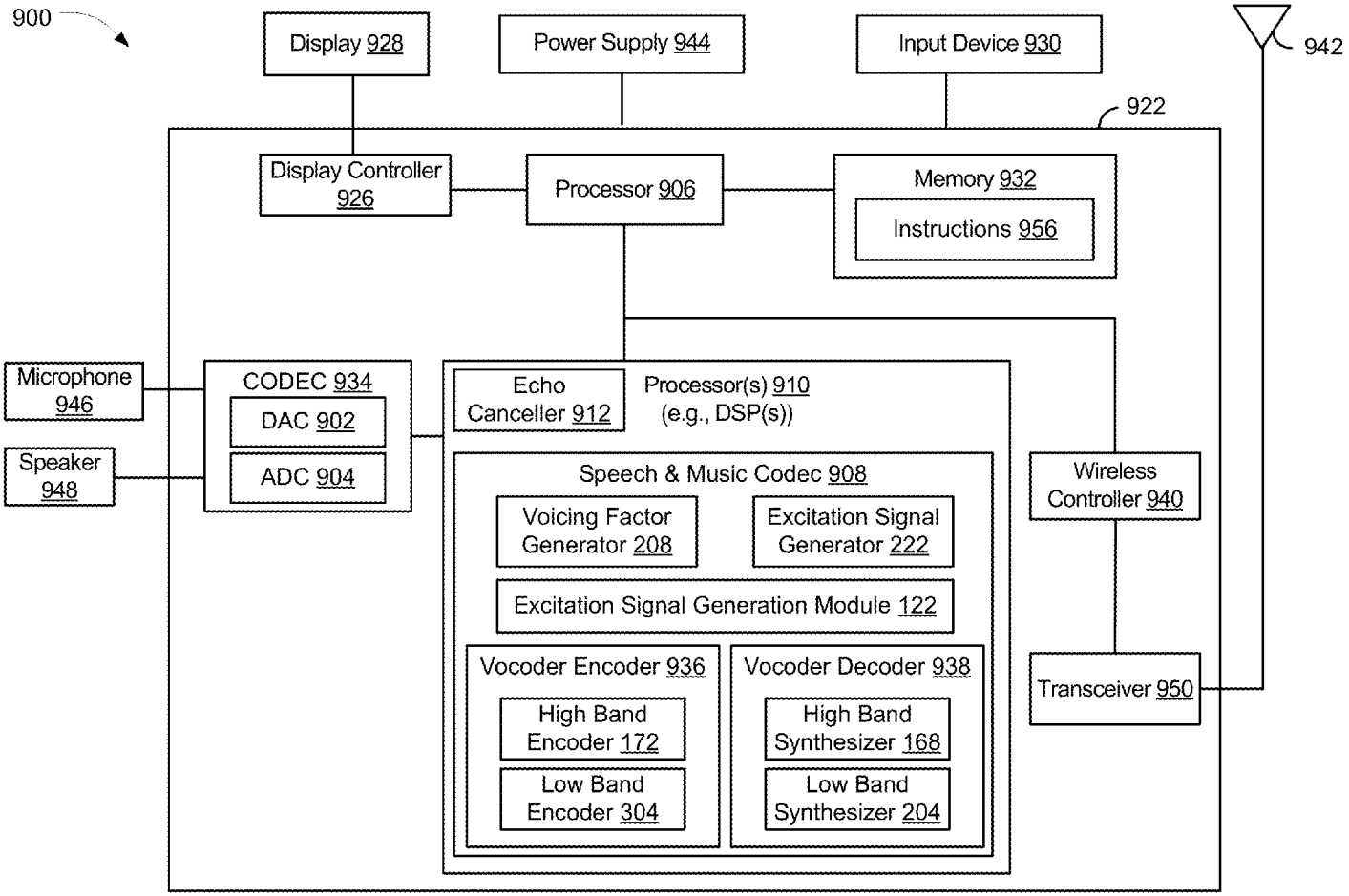
FIG. 9 is a block diagram of a device operable to perform high band excitation signal generation in accordance with the systems and methods of FIGS. 1-8.

Referring to FIG. 9, a block diagram of a particular illustrative embodiment of a device (e.g., a wireless communication device) is depicted and generally designated 900. In various embodiments, the device 900 may have fewer or more components than illustrated in FIG. 9. In an illustrative embodiment, the device 900 may correspond to the mobile device 104 or the first device 102 of FIG. 1. In an illustrative embodiment, the device 900 may operate according to one or more of the methods 400-800 of FIGS. 4-8.

In a particular embodiment, the device 900 includes a processor 906 (e.g., a central processing unit (CPU)). The device 900 may include one or more additional processors 910 (e.g., one or more digital signal processors (DSPs)). The processors 910 may include a speech and music coder-decoder (CODEC) 908, and an echo canceller 912. The speech and music CODEC 908 may include the excitation signal generation module 122 of FIG. 1, the excitation signal generator 222, the voicing factor generator 208 of FIG. 2, a vocoder encoder 936, a vocoder decoder 938, or both. In a particular embodiment, the vocoder encoder 936 may include the high band encoder 172 of FIG. 1, the low band encoder 304 of FIG. 3, or both. In a particular embodiment, the vocoder decoder 938 may include the high band synthesizer 168 of FIG. 1, the low band synthesizer 204 of FIG. 2, or both.

As illustrated, the excitation signal generation module 122, the voicing factor generator 208, and the excitation signal generator 222 may be shared components that are accessible by the vocoder encoder 936 and the vocoder decoder 938. In other embodiments, one or more of the excitation signal generation module 122, the voicing factor generator 208, and/or the excitation signal generator 222 may be included in the vocoder encoder 936 and the vocoder decoder 938.

Although the speech and music codec 908 is illustrated as a component of the processors 910 (e.g., dedicated circuitry and/or executable programming code), in other embodiments one or more components of the speech and music codec 908, such as the excitation signal generation module 122, may be included in the processor 906, the CODEC 934, another processing component, or a combination thereof.

The device 900 may include a memory 932 and a CODEC 934. The device 900 may include a wireless controller 940 coupled to an antenna 942 via transceiver 950. The device 900 may include a display 928 coupled to a display controller 926. A speaker 948, a microphone 946, or both, may be coupled to the CODEC 934. In a particular embodiment, the speaker 948 may correspond to the speaker 142 of FIG.

1. In a particular embodiment, the microphone 946 may correspond to the microphone 146 of FIG. 1. The CODEC 934 may include a digital-to-analog converter (DAC) 902 and an analog-to-digital converter (ADC) 904.

In a particular embodiment, the CODEC 934 may receive analog signals from the microphone 946, convert the analog signals to digital signals using the analog-to-digital converter 904, and provide the digital signals to the speech and music codec 908, such as in a pulse code modulation (PCM) format. The speech and music codec 908 may process the digital signals. In a particular embodiment, the speech and music codec 908 may provide digital signals to the CODEC 934. The CODEC 934 may convert the digital signals to analog signals using the digital-to-analog converter 902 and may provide the analog signals to the speaker 948.

The memory 932 may include instructions 956 executable by the processor 906, the processors 910, the CODEC 934, another processing unit of the device 900, or a combination thereof, to perform methods and processes disclosed herein, such as one or more of the methods 400-800 of FIGS. 4-8.

One or more components of the systems 100-300 may be implemented via dedicated hardware (e.g., circuitry), by a processor executing instructions to perform one or more tasks, or a combination thereof. As an example, the memory 932 or one or more components of the processor 906, the processors 910, and/or the CODEC 934 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 956) that, when executed by a computer (e.g., a processor in the CODEC 934, the processor 906, and/or the processors 910), may cause the computer to perform at least a portion of one or more of the methods 400-800 of FIGS. 4-8. As an example, the memory 932 or the one or more components of the processor 906, the processors 910, the CODEC 934 may be a non-transitory computer-readable medium that includes instructions (e.g., the instructions 956) that, when executed by a computer (e.g., a processor in the CODEC 934, the processor 906, and/or the processors 910), cause the computer perform at least a portion of one or more of the methods 400-800 of FIGS. 4-8.

In a particular embodiment, the device 900 may be included in a system-in-package or system-on-chip device (e.g., a mobile station modem (MSM)) 922. In a particular embodiment, the processor 906, the processors 910, the display controller 926, the memory 932, the CODEC 934, the wireless controller 940, and the transceiver 950 are included in a system-in-package or the system-on-chip device 922. In a particular embodiment, an input device 930, such as a touchscreen and/or keypad, and a power supply 944 are coupled to the system-on-chip device 922. Moreover, in a particular embodiment, as illustrated in FIG. 9, the display 928, the input device 930, the speaker 948, the microphone 946, the antenna 942, and the power supply 944 are external to the system-on-chip device 922. However, each of the display 928, the input device 930, the speaker 948, the microphone 946, the antenna 942, and the power supply 944 can be coupled to a component of the system-on-chip device 922, such as an interface or a controller.

The device 900 may include a mobile communication device, a smart phone, a cellular phone, a laptop computer, a computer, a tablet, a personal digital assistant, a display device, a television, a gaming console, a music player, a radio, a digital video player, a digital video disc (DVD) player, a tuner, a camera, a navigation device, a decoder system, an encoder system, or any combination thereof.

In an illustrative embodiment, the processors 910 may be operable to perform all or a portion of the methods or operations described with reference to FIGS. 1-8. For example, the microphone 946 may capture an audio signal (e.g., the input signal 130 of FIG. 1). The ADC 904 may convert the captured audio signal from an analog waveform into a digital waveform comprised of digital audio samples. The processors 910 may process the digital audio samples. A gain adjuster may adjust the digital audio samples. The echo canceller 912 may reduce an echo that may have been created by an output of the speaker 948 entering the microphone 946.

The vocoder encoder 936 may compress digital audio samples corresponding to the processed speech signal and may form a transmit packet (e.g. a representation of the compressed bits of the digital audio samples). For example, the transmit packet may correspond to at least a portion of the bit stream 132 of FIG. 1. The transmit packet may be stored in the memory 932. The transceiver 950 may modulate some form of the transmit packet (e.g., other information may be appended to the transmit packet) and may transmit the modulated data via the antenna 942.

As a further example, the antenna 942 may receive incoming packets that include a receive packet. The receive packet may be sent by another device via a network. For example, the receive packet may correspond to at least a portion of the bit stream 132 of FIG. 1. The vocoder decoder 938 may uncompress the receive packet. The uncompressed waveform may be referred to as reconstructed audio samples. The echo canceller 912 may remove echo from the reconstructed audio samples.

The processors 910 executing the speech and music codec 908 may generate the high band excitation signal 186, as described with reference to FIGS. 1-8. The processors 910 may generate the output signal 116 of FIG. 1 based on the high band excitation signal 186. A gain adjuster may amplify or suppress the output signal 116. The DAC 902 may convert the output signal 116 from a digital waveform to an analog waveform and may provide the converted signal to the speaker 948.

In conjunction with the described embodiments, an apparatus is disclosed that includes means for determining a voicing classification of an input signal. The input signal may correspond to an audio signal. For example, the means for determining a voicing classification may include the voicing classifier 160 of FIG. 1, one or more devices configured to determine the voicing classification of an input signal (e.g., a processor executing instructions at a non-transitory computer readable storage medium), or any combination thereof.

For example, the voicing classifier 160 may determine the parameters 242 including a zero crossing rate of a low band signal of the input signal 130, a first reflection coefficient, a ratio of energy of an adaptive codebook contribution in low band excitation to energy of a sum of adaptive codebook and fixed codebook contributions in low band excitation, pitch gain of the low band signal of the input signal 130, or a combination thereof. In a particular embodiment, the voicing classifier 160 may determine the parameters 242 based on the low band signal 334 of FIG. 3. In an alternative embodiment, the voicing classifier 160 may extract the parameters 242 from the low band portion of bit stream 232 of FIG. 2.

The voicing classifier 160 may determine the voicing classification 180 (e.g., the voicing factor 236) based on an equation. For example, the voicing classifier 160 may determine the voicing classification 180 based on Equation 1 and the parameters 242. To illustrate, the voicing classifier 160 may determine the voicing classification 180 by calculating a weighted sum of the zero crossing rate, the first reflection coefficient, the ratio of energy, the pitch gain, the previous voicing decision, a constant value, or a combination thereof, as described with reference to FIG. 4.

The apparatus also includes means for controlling an amount of an envelope of a representation of the input signal based on the voicing classification. For example, the means for controlling the amount of the envelope may include the envelope adjuster 162 of FIG. 1, one or more devices configured to control the amount of the envelope of the representation of the input signal based on the voicing classification (e.g., a processor executing instructions at a non-transitory computer readable storage medium), or any combination thereof.

For example, the envelope adjuster 162 may generate a frequency voicing classification by multiplying the voicing classification 180 of FIG. 1 (e.g., the voicing factor 236 of FIG. 2) by a cut-off frequency scaling factor. The cut-off frequency scaling factor may be a default value. The LPF cut-off frequency 426 may correspond to a default cut-off frequency. The envelope adjuster 162 may control an amount of the signal envelope 182 by adjusting the LPF cut-off frequency 426, as described with reference to FIG. 4. For example, the envelope adjuster 162 may adjust the LPF cut-off frequency 426 by adding the frequency voicing classification to the LPF cut-off frequency 426.

As another example, the envelope adjuster 162 may generate the bandwidth expansion factor 526 by multiplying the voicing classification 180 of FIG. 1 (e.g., the voicing factor 236 of FIG. 2) by a bandwidth scaling factor. The envelope adjuster 162 may determine the high band LPC poles associated with the representative signal 422. The envelope adjuster 162 may determine a pole adjustment factor by multiplying the bandwidth expansion factor 526 by a pole scaling factor. The pole scaling factor may be a default value. The envelope adjuster 162 may control the amount of the signal envelope 182 by adjusting the high band LPC poles, as described with reference to FIG. 5. For example, the envelope adjuster 162 may adjust the high band LPC poles towards origin by the pole adjustment factor.

As a further example, the envelope adjuster 162 may determine coefficients of a filter. The coefficients of the filter may be default values. The envelope adjuster 162 may determine a filter adjustment factor by multiplying the bandwidth expansion factor 526 by a filter scaling factor. The filter scaling factor may be a default value. The envelope adjuster 162 may control the amount of the signal envelope 182 by adjusting the coefficients of the filter, as described with reference to FIG. 6. For example, the envelope adjuster 162 may multiply each of the coefficients of the filter by the filter adjustment factor.

The apparatus further includes means for modulating a white noise signal based on the controlled amount of the envelope. For example, the means for modulating the white noise signal may include the modulator 164 of FIG. 1, one or more devices configured to modulate the white noise signal based on the controlled amount of the envelope (e.g., a processor executing instructions at a non-transitory computer readable storage medium), or any combination thereof. For example, the modulator 164 may determine whether the white noise 156 and the signal envelope 182 are in the same domain. If the white noise 156 is in a different domain than the signal envelope 182, the modulator 164 may convert the white noise 156 to be in the same domain as the signal envelope 182 or may convert the signal envelope 182 to be in the same domain as the white noise 156. The modulator 164 may modulate the white noise 156 based on the signal envelope 182, as described with reference to FIG. 4. For example, the modulator 164 may multiply the white noise 156 and the signal envelope 182 in a time domain. As another example, the modulator 164 may convolve the white noise 156 and the signal envelope 182 in a frequency domain.

The apparatus also includes means for generating a high band excitation signal based on the modulated white noise signal. For example, the means for generating the high band excitation signal may include the output circuit 166 of FIG. 1, one or more devices configured to generate the high band excitation signal based on the modulated white noise signal (e.g., a processor executing instructions at a non-transitory computer readable storage medium), or any combination thereof.

In a particular embodiment, the output circuit 166 may generate the high band excitation signal 186 based on the modulated white noise 184, as described with reference to FIGS. 4-7. For example, the output circuit 166 may multiply the modulated white noise 184 and the noise gain 434 to generate the scaled modulated white noise 438, as described with reference to FIGS. 4-6. The output circuit 166 may combine the scaled modulated white noise 438 and another signal (e.g., the scaled representative signal 440 of FIG. 4, the scaled filtered signal 540 of FIG. 5, or the scaled synthesized high band signal 640 of FIG. 6) to generate the high band excitation signal 186.

As another example, the output circuit 166 may multiply the modulated white noise 184 and the modulated noise gain 732 of FIG. 7 to generate the scaled modulated white noise 740, as described with reference to FIG. 7. The output circuit 166 may combine (e.g., add) the scaled modulated white noise 740 and the scaled unmodulated white noise 742 to generate the scaled white noise 744. The output circuit 166 may combine the scaled representative signal 440 and the scaled white noise 744 to generate the high band excitation signal 186.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A method comprising:

extracting a voicing classification parameter of an input signal based on a received bitstream, wherein the input signal corresponds to an audio signal;

controlling a frequency range of an envelope of a representation of the input signal based on the voicing classification parameter, the frequency range controlled based on a cut-off frequency of a low-pass filter applied to the representation of the input signal;

modulating a white noise signal based on the controlled frequency range of the envelope; and generating a high band excitation signal corresponding to a decoded version of the audio signal based on the modulated white noise signal.

2. The method of claim 1, further comprising controlling a magnitude of the envelope.

3. The method of claim 1, further comprising controlling at least one of a shape of the envelope or a gain of the envelope.

4. The method of claim 3, wherein an extent of variation of the shape of the envelope is greater when the voicing classification parameter corresponds to strongly voiced than when the voicing classification parameter corresponds to strongly unvoiced.

5. The method of claim 1, wherein the voicing classification parameter indicates whether the input signal is a strongly voice signal, a weakly voiced signal, a weakly unvoiced signal, or a strongly unvoiced signal.

6. The method of claim 1, further comprising determining the cut-off frequency based on the voicing classification parameter.

7. The method of claim 1, wherein the cut-off frequency is greater when the voicing classification parameter corresponds to strongly voiced than when the voicing classification parameter corresponds to strongly unvoiced.

8. The method of claim 1, wherein extracting the voicing classification parameter is performed by a decoder.

9. The method of claim 1, wherein controlling the frequency range of the envelope of the representation of the input signal based on the voicing classification parameter is performed by a mobile communication device.

10. The method of claim 1, wherein controlling the frequency range of the envelope of the representation of the input signal based on the voicing classification parameter is performed by a fixed location communication unit.

11. The method of claim 1, wherein controlling the frequency range of the envelope of the representation comprises adjusting the representation of the input signal in a transform domain.

12. The method of claim 1, wherein the representation of the input signal includes a low band excitation signal of an encoded version of the audio signal or a high band excitation signal of the encoded version of the audio signal.

13. The method of claim 1, wherein the representation of the input signal includes a harmonically extended excitation signal and wherein the harmonically extended excitation signal is generated from a low band excitation signal of an encoded version of the audio signal.

14. The method of claim 1, further comprising generating a scaled white noise signal by combining a scaled unmodulated white noise signal with a scaled modulated white noise signal, wherein the high band excitation signal is based on the scaled white noise signal.

15. The method of claim 1, wherein the envelope comprises a time-varying envelope, and further comprising updating the envelope more than once per frame of the input signal.

16. An apparatus comprising:

a voicing classifier configured to extract a voicing classification parameter of an input signal based on a received bitstream, wherein the input signal corresponds to an audio signal;

an envelope adjuster configured to control a frequency range of an envelope of a representation of the input signal based on the voicing classification parameter, the frequency range controlled based on a cut-off frequency of a low-pass filter applied to the representation of the input signal;

a modulator configured to modulate a white noise signal based on the controlled frequency range of the envelope; and an output circuit configured to generate a high band excitation signal based on the modulated white noise signal.

17. The apparatus of claim 16, wherein the envelope adjuster is configured to control, based on the voicing classification parameter, at least one of a shape of the envelope, a magnitude of the envelope, or a gain of the envelope.

18. The apparatus of claim 17, wherein at least one of the shape of the envelope, the magnitude of the envelope, or the gain of the envelope is controlled by adjusting one or more poles of linear predictive coding (LPC) coefficients based on the voicing classification parameter.

19. The apparatus of claim 17, wherein at least one of the shape of the envelope, the magnitude of the envelope, or the gain of the envelope is configured to be controlled based on adjusted coefficients of a filter, the adjusted coefficients determined based on the voicing classification parameter, and wherein the modulator is configured to apply the filter to the white noise signal to generate the modulated white noise signal.

20. The apparatus of claim 16, further comprising an antenna; and a receiver coupled to the antenna and configured to receive the bitstream.

21. The apparatus of claim 20, wherein the receiver, the voicing classifier, the envelope adjuster, the modulator, and the output circuit are integrated into a mobile communication device.

22. The apparatus of claim 20, wherein the receiver, the voicing classifier, the envelope adjuster, the modulator, and the output circuit are integrated into a fixed location communication unit.

23. The apparatus of claim 16, further comprising:

a high band encoder configured to encode a high band portion of the audio signal based on the high band excitation signal; and a transmitter configured to transmit an encoded audio signal to another device, wherein the encoded audio signal is an encoded version of the audio signal.

24. A computer-readable storage device storing instructions that, when executed by at least one processor, cause the at least one processor to:

extract a voicing classification parameter of an input signal based on a received bitstream, wherein the input signal corresponds to an audio signal;

control a frequency range of an envelope of a representation of the input signal based on the voicing classification parameter, the frequency range controlled based on a cut-off frequency of a low-pass filter applied to the representation of the input signal;

modulate a white noise signal based on the controlled frequency range of the envelope; and generate a high band excitation signal based on the modulated white noise signal.

25. The computer-readable storage device of claim 24, wherein the instructions are further executable to cause the at least one processor to control a shape of the envelope based on the voicing classification parameter.

26. The computer-readable storage device of claim 24, wherein the instructions are further executable to cause the at least one processor to control at least one of a magnitude of the envelope or a gain of the envelope.

27. An apparatus comprising:

means for extracting a voicing classification parameter of an input signal based on a received bitstream, wherein the input signal corresponds to an audio signal;

means for controlling a frequency range of an envelope of a representation of the input signal based on the voicing classification parameter, the frequency range controlled based on a cut-off frequency of a low-pass filter applied to the representation of the input signal;

means for modulating a white noise signal based on the controlled frequency range of the envelope; and means for generating a high band excitation signal based on the modulated white noise signal.

28. The apparatus of claim 27, wherein the representation of the input signal includes a low band excitation signal of the input signal, a high band excitation signal of the input signal, or a harmonically extended excitation signal, wherein the harmonically extended excitation signal is generated from the low band excitation signal of the input signal.

29. The apparatus of claim 27, wherein the means for extracting, the means for controlling, the means for modulating, and the means for generating are integrated into a mobile communication device.

30. The apparatus of claim 27, wherein the means for extracting, the means for controlling, the means for modulating, and the means for generating are integrated into a fixed location communication unit.

* * * * *